US007505011B2

(12) United States Patent
Nakanishi et al.

(10) Patent No.: US 7,505,011 B2
(45) Date of Patent: Mar. 17, 2009

(54) ANTENNA APPARATUS

(75) Inventors: Tomoya Nakanishi, Osaka (JP); Hiroyuki Uno, Ishikawa (JP); Yutaka Saito, Ishikawa (JP)

(73) Assignee: Panasonic Corporation, Osaka (JP)

( * ) Notice: Subject to any disclaimer, the term of this patent is extended or adjusted under 35 U.S.C. 154(b) by 111 days.

(21) Appl. No.: 11/630,379

(22) PCT Filed: Nov. 28, 2005

(86) PCT No.: PCT/JP2005/021802

§ 371 (c)(1),
(2), (4) Date: Dec. 22, 2006

(87) PCT Pub. No.: WO2006/059568

PCT Pub. Date: Jun. 8, 2006

(65) Prior Publication Data

US 2008/0018546 A1 Jan. 24, 2008

(30) Foreign Application Priority Data

Nov. 30, 2004 (JP) ..... 2004-345379

(51) Int. Cl.
*H01Q 13/10* (2006.01)

(52) U.S. Cl. ..... 343/770; 343/733; 343/876

(58) Field of Classification Search ..... 343/767, 343/770, 733, 876
See application file for complete search history.

(56) References Cited

U.S. PATENT DOCUMENTS 6,501,436 B1 * 12/2002 Saito et al. ..... 343/867
6,573,874 B1 6/2003 Saito et al. ..... 343/805
7,227,509 B2 * 6/2007 Saito et al. ..... 343/834

FOREIGN PATENT DOCUMENTS

| | | |
|---|---|---|
| JP | 61288503 | 12/1986 |
| JP | 5327335 | 12/1993 |
| JP | 06334434 | 12/1994 |
| JP | 10126143 | 5/1998 |
| JP | 2003142919 | 5/2003 |
| JP | 2004-228650 | 8/2004 |

OTHER PUBLICATIONS

PCT International Search Report dated Feb. 21, 2006.

(Continued)

*Primary Examiner*—Trinh V Dinh
*Assistant Examiner*—Dieu Hien T Duong
(74) *Attorney, Agent, or Firm*—Dickinson Wright, PLLC

(57) ABSTRACT

An antenna apparatus capable of main beam direction switching is provided that achieves high gain with a small, planar configuration. Rhombic antenna sections composed of linear elements 101*a* through 101*d*, 102*a* through 102*d*, and 103*a* through 103*d* are arranged in the same plane, and the rhombic antenna sections are connected by linear linking elements 104*a* through 104*d*. Linear detour elements 105*a* and 105*b* are connected to the pair of vertices of the rhombic antenna sections arranged at each end. Feed points 106*a* and 106*b* are provided at the other opposite two pairs of vertices of any of the rhombic antenna sections, and the opposite vertices of the other rhombic antenna sections are connected by linear elements. A plate reflector is arranged at a distance h from, and parallel to, the surface on which the rhombic antenna elements are arranged.

8 Claims, 21 Drawing Sheets

OTHER PUBLICATIONS

H. Uno, et al., "A Planar Loop Antenna with Detour Elements for WLAN Terminal," IEICE Technical Report (Shingaku Giho A.P. 2003-157), vol. 103, No. 456, Nov. 13, 2003, pp. 69-74.

H. Uno, et al., "A Planar Six-Sector Antenna Using Loop Antenna with Detour Elements for WLAN Card Terminal," IEICE, Proceedings of ISAP '04, Sendai, Japan, Nov. 2003, pp. 909-912.

* cited by examiner (a) VERTICAL (XZ) PLANE DIRECTIVITY (b) CONICAL PLANE DIRECTIVITY ($\theta$=70 DEGREES)

(a) VERTICAL PLANE DIRECTIVITY (φ=5 DEGREES)

(b) VERTICAL PLANE DIRECTIVITY (φ=-5 DEGREES)

(c) CONICAL PLANE DIRECTIVITY (θ=70 DEGREES)

(d) CONICAL PLANE DIRECTIVITY (θ=-70 DEGREES)

(a) (b)

(b) CONICAL PLANE DIRECTIVITY ($\theta$=45 DEGREES)

(a) VERTICAL (XZ) PLANE DIRECTIVITY (b) CONICAL PLANE DIRECTIVITY (θ= 40 DEGREES)

(a) VERTICAL (XZ) PLANE DIRECTIVITY

ANTENNA APPARATUS

This application is a national stage application of PCT application number PCT/JP2005/021802, filed on Nov. 28, 2005.

TECHNICAL FIELD

The present invention relates to a small planar antenna apparatus capable of main beam direction switching, and is suitable for use as a high speed radio communication antenna in, for example, road-to-vehicle communication or vehicle-to-vehicle communication.

BACKGROUND ART

In recent years, road-to-vehicle communication systems and vehicle-to-vehicle communication systems using 25 GHz band, 60 GHz band, and so forth, have been studied. In these communication systems, since the antenna apparatus installed in a vehicle is positioned comparatively close to the road (inside a bumper, for example), there is a problem that reflection from the road cannot be ignored and transmission quality degrades due to fading. Therefore, the antenna apparatus installed in a vehicle needs to have narrow directivity to the vertical direction with respect to the road, and to have a small configuration. It is also preferable that the antenna apparatus has high gain in order to extend the communication distance, and can switch the beam direction within the horizontal plane according to the course of the road since a road is assumed to curve as well as to run in a straight line.

Up to now, a planar patch array antenna has been known as an antenna for achieving high gain with a small, planar configuration. This antenna narrows beam directivity in the main radiation direction and achieves high gain by having a plurality of antenna elements arranged within a plane perpendicular to the main radiation direction and performing distribution feeding (see Patent Document 1, for example.)

Also, a patch Yagi-Uda array antenna has been proposed as an antenna capable of switching beam (see Patent Document 2, for example). FIG. 20 is a drawing showing the configuration of a patch Yagi-Uda array antenna described in Patent Document 2. This antenna is configured with feed elements 2001*a* through 2001*d*, passive element 2002, and passive element groups 2003*a* through 2003*d*, and achieves small antenna apparatus size by sharing the wave directors (passive elements) that account for the major part of a Yagi-Uda array antenna. By switching power feeding to feed elements 2001*a* through 2001*d*, it is possible to switch beam in four directions with the antenna apparatus shown in this figure.

A detour element loaded loop antenna has been proposed as another beam switching antenna (see Non-Patent Document 1, for example.) FIG. 21 is a drawing showing the configuration of the detour element loaded loop antenna described in Non-Patent Document 1. As shown in the figure, linear elements 2101*a* through 2101*d* are arranged in a rhombic shape, linear detour element 2102*a* is connected between linear elements 2101*a* and 2101*c*, and linear detour element 2102*b* is connected between linear elements 2101*b* and 2101*d*. Feed point 2103*a* is provided between linear elements 2101*a* and 2101*b*, and feed point 2103*b* is provided between linear elements 2101*c* and 2101*d*. Plate reflector 2104 is arranged parallel to the antenna elements configured as described above. By configuring an antenna apparatus in this way, and switching between feed points 2103*a* and 2103*b*, it is possible to switch the main beam in two directions. By this means, it is possible to switch beam with a planar, small configuration.

Patent Document 1: Japanese Patent Application Laid-Open No. HEI6-334434

Patent Document 2: Japanese Patent Application Laid-Open No. 2003-142919

Non-Patent Document 1: Technical report A-P2003-157 of The Institute of Electronics, Information and Communication Engineers, November 2003

DISCLOSURE OF INVENTION

Problems to be Solved by the Invention

However, the planar patch array antenna described in Patent Document 1 has a problem that, since the main beam direction cannot be switched, transmission quality degrades significantly depending on the vehicle driving condition. Another problem is that the influence of feed loss increases because of the array configuration using distribution feeding.

Also, the patch Yagi-Uda array antenna described in Patent Document 2 has a problem that it is necessary to increase the number of elements in order to achieve higher gain, thereby resulting in a larger antenna size.

Furthermore, the detour element loaded loop antenna described in Non-Patent Document 1 has a problem that, since the beam width is large, reflection is easily received from the road surface. Thus, it is necessary to further narrow directivity.

The present invention has been made taking into account the problems described above, and it is therefore an object of the present invention to provide an antenna apparatus that achieves high gain with a small, planar configuration and capable of main beam direction switching.

Means for Solving the Problems

In order to solve the above described problems with the prior art, an antenna apparatus of the present invention has the features described below. Firstly, an antenna apparatus adopts a configuration having a plurality of rhombic antenna sections in which four linear elements having lengths of approximately ¼ of the wavelength to approximately ⅜ of the wavelength of the used frequency are arranged in a rhombic shape in the same plane, and of the four linear elements, a first linear element and second linear element are connected, and a third linear element and fourth linear element are connected, wherein the plurality of rhombic antenna sections are connected by a linear linking element having a predetermined length, a folded-back linear detour element having a predetermined full length is connected to each end of the linked plurality of rhombic antenna sections, and a plate reflector is arranged at a predetermined distance from the plane in which the plurality of rhombic elements are arranged, and approximately parallel to the plane, the antenna apparatus having a first feed point that feeds power to the junction of the first linear element and second linear element of the plurality of rhombic antenna sections, a second feed point that feeds power to a junction of the third linear element and fourth linear element, and a switching section that switches selectively between the first feed point and second feed point.

According to this configuration, it is possible to achieve high gain with a small, planar antenna apparatus. Also, by switching selectively between the first feed point and second feed point, it is possible to switch the main beam in two directions. Furthermore, it is possible to vary the angle of the main beam in the horizontal direction.

Advantageous Effect of the Invention

As described above, an antenna apparatus of the present invention can achieve high gain and switch the main beam in two directions with a small, planar configuration. In addition, it is possible to switch the angle of the main beam in the horizontal direction.

BEST MODE FOR CARRYING OUT THE INVENTION

Antenna apparatuses of embodiments of the present invention will now be described in detail with reference to the accompanying drawings.

Embodiment 1

Figure 1:
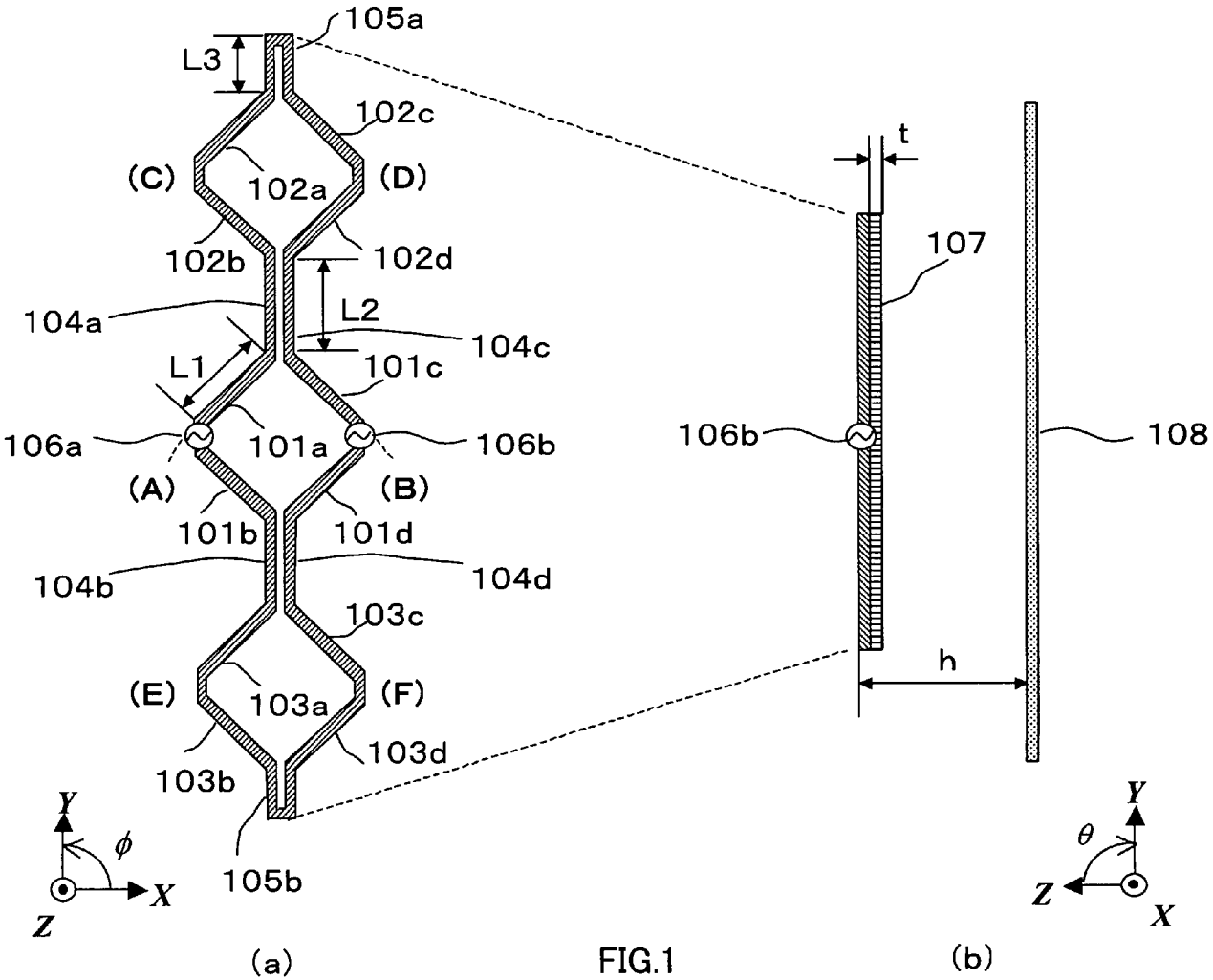
FIG. 1 is a configuration diagram of an antenna apparatus according to Embodiment 1 of the present invention.

FIG. 1 is a drawing showing the configuration of an antenna apparatus according to Embodiment 1 of the present invention. Below, a case will be described in which an antenna is created on a dielectric substrate of, for example, $\epsilon r=2.26$, assuming that its operating frequency is 25 GHz and one wavelength (one effective wavelength) is 8.6 mm. The coordinate axes shown in FIG. 1 are defined for convenience of explanation.

FIG. 1(*a*) is a planar view showing the configuration of an antenna apparatus according to Embodiment 1 of the present invention. In this figure, linear elements 101*a* through 101*d*, 102*a* through 102*d*, and 103*a* through 103*d* are electrical conductors with element length L1 of approximately ⅓ wavelength (2.8 mm), and an element width of, for example, 0.2 mm. These linear elements 101*a* through 101*d*, 102*a* through 102*d*, and 103*a* through 103*d* are arranged in square shapes as shown in FIG. 1(*a*).

Linear linking elements 104*a* through 104*d* are electrical conductors with element length L2 of approximately ⅔ wavelength (3.3 mm), and an element width of, for example, 0.2 mm. Linear linking element 104*a* is connected between linear element 101*a* and linear element 102*b*, linear linking element 104*b* is connected between linear element 101*b* and linear element 103*a*, linear linking element 104*c* is connected between linear element 101*c* and linear element 102*d*, and linear linking element 104*d* is connected between linear element 101*d* and linear element 103*c*.

Linear detour elements 105*a* and 105*b* are folded-back electrical conductors with a full length of approximately ⅔ wavelength (3.3 mm), element length L3 of approximately ⅕ wavelength (1.7 mm), and an element width of, for example, 0.2 mm. Linear detour element 105*a* is connected between linear element 102*a* and linear element 102*c*, and linear detour element 105*b* is connected between linear element 103*b* and linear element 103*d*.

Feed point 106*a* is provided between linear elements 101*a* and 101*b*, and feed point 106*b* is provided between linear elements 101*c* and 101*d*. Linear elements 102*a* and 102*b*, linear elements 102*c* and 102*d*, linear elements 103*a* and 103*b*, and linear elements 103*c* and 103*d*, are connected.

Linear antenna elements in which rhombic antenna sections are connected in an array configuration are configured with linear elements 101*a* through 101*d*, 102*a* through 102*d*, and 103*a* through 103*d*, linear linking elements 104*a* and 104*b*, linear detour elements 105*a* and 105*b*, and feed points 106*a* and 106*b*, configured as described above.

Rectangles in general including the above square shapes are applicable to the above described rhombic antenna sections. For example, quadrilaterals, squares, parallelograms, and trapezoids—as well as curved and round shapes—are applicable. Hereinafter, when "rhombic antenna section" is referred to, it is used as a generic term for antenna sections shaped as quadrilaterals, squares, parallelograms, or trapezoids, as well as curved or round shapes for convenience of explanation.

When linear antenna elements are excited from feed point 106*a*, feed point 106*b* is shorted, and linear elements 101*c* and 101*d* operate so as to be connected. Conversely, when linear antenna elements are excited from feed point 106*b*, feed point 106*a* is shorted, and linear elements 101*a* and 101*b* operate so as to be connected. By switching feed points in this way and exciting linear antenna elements, it is possible to switch the main beam in two directions with one linear antenna element.

FIG. 1(*b*) is an arrow view showing the configuration of an antenna apparatus according to Embodiment 1 of the present invention, viewed from the +X side of FIG. 1(*a*). In this figure, dielectric substrate 107 has thickness t of approximately 0.05 wavelength (0.4 mm), and is arranged on the −Z side parallel to the surface (XY plane) on which the linear antenna elements are arranged. Plate reflector 108 is a conductive plate arranged at a position where distance h is approximately 0.6 wavelength (5 mm) on the −Z side from the surface (XY plane) on which the linear antenna elements are arranged.

Figure 2:
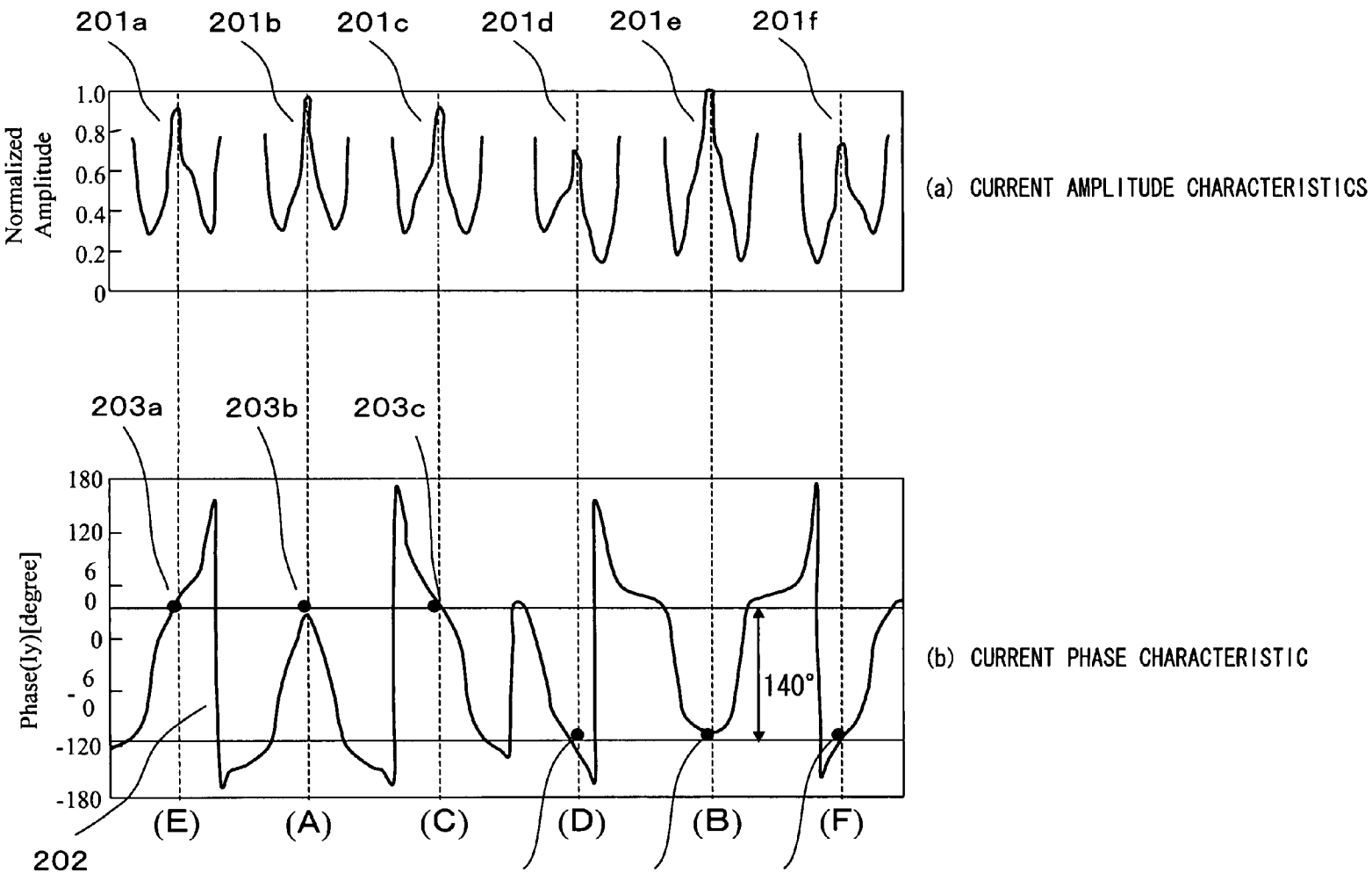
FIG. 2 is a drawing showing current amplitude and current phase of an antenna apparatus according to Embodiment 1 of the present invention.

The operation of the above described antenna apparatus will now be explained using FIG. 2. FIG. 2 is a drawing showing current distribution on the linear antenna elements when feed point 106*a* is excited and feed point 106*b* is shorted, FIG. 2(*a*) shows current amplitude characteristics, and FIG. 2(*b*) shows current phase characteristics. Symbols (A) through (F) shown on the horizontal axis in FIG. 2 correspond to the positions indicated by symbols (A) through (F) in FIG. 1.

In FIG. 2(*a*), current amplitude characteristic 201*a* indicates the current amplitude on linear elements 103*a* and 103*b*, and it can be confirmed that the current amplitude is at its peak value at point (E). Similarly, characteristic 201*b* indicates the current amplitude on linear elements 101*a* and 101*b*, characteristic 201*c* indicates the current amplitude on linear elements 102*a* and 102*b*, characteristic 201*d* indicates the current amplitude on linear elements 102*c* and 102*d*, characteristic 201*e* indicates the current amplitude on linear elements 101*c* and 101*d*, and characteristic 201*f* indicates the current amplitude on linear elements 103*c* and 103*d*, and it can be confirmed that the current amplitudes are at their peak values at point (A), point (C), point (D), point (B) and point (F), respectively.

In FIG. 2(*b*), current phase characteristic 202 indicates the current phase of the Y direction component. Here, phases 203*a*, 203*b*, 203*c*, 203*d*, 203*e* and 203*f* are the current phases at point (E), point (A), point (C), point (D), point (B) and point (F), respectively.

From FIG. 2(*b*), it can be confirmed that the peak points on linear elements arranged on the −X side in FIG. 1—that is, phases 203*a*, 203*b* and 203*c* at point (A), point (C) and point (E)—approximately coincide, and the peak points on linear elements arranged on the +X side—that is, phases 203*d*, 203*e* and 203*f* at point (B), point (D) and point (F)—approximately coincide. At this time, it can be confirmed that a phase difference of approximately 140 degrees occurs between phases 203*a*, 203*b* and 203*c*, and phases 203*d*, 203*e* and 203*f*. Consequently, when the antenna apparatus according to Embodiment 1 of the present invention is excited from feed point 106*a*, a beam tilted toward the +X side is obtained, and the antenna apparatus operates as a beam tilt antenna. Conversely, when the antenna apparatus is excited from feed point 106*b*, a beam tilted toward the −X side is obtained.

Figure 3:
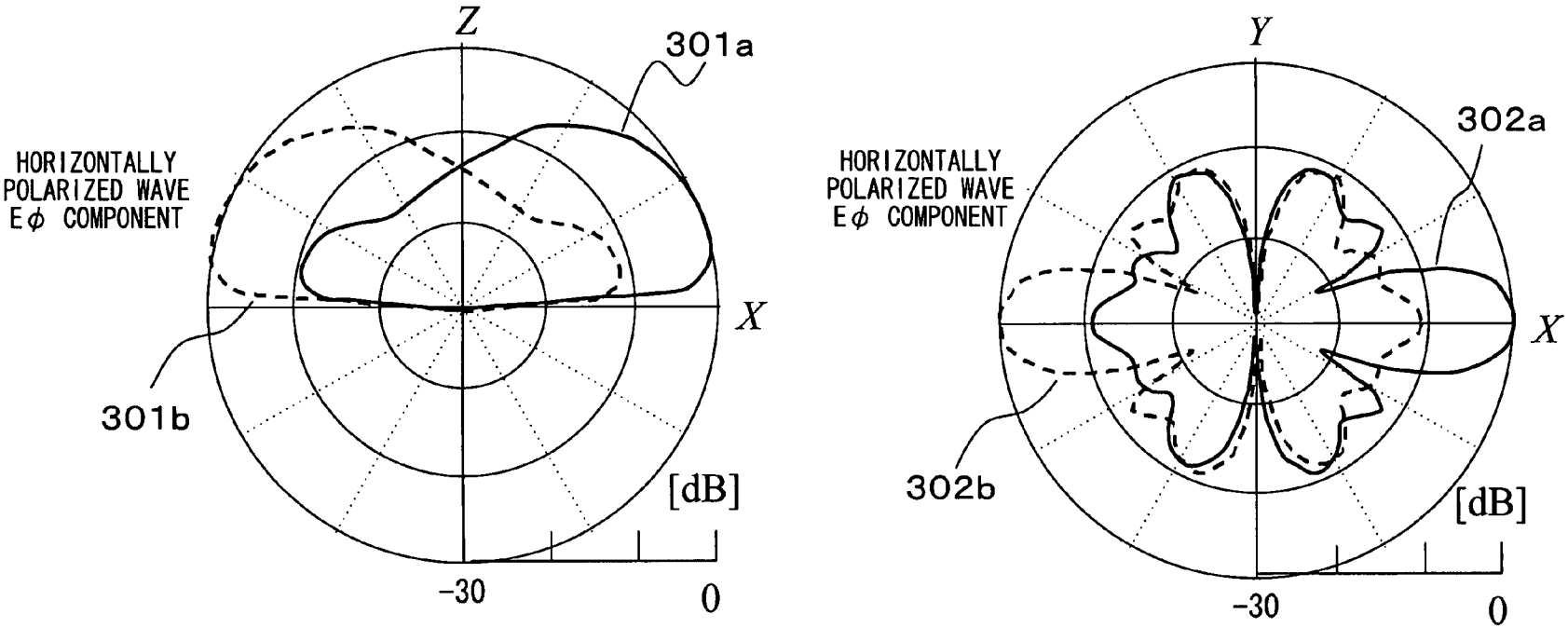
FIG. 3 is a drawing showing the directivity of an antenna apparatus according to Embodiment 1 of the present invention.

FIG. 3 is a drawing showing the directivity of an antenna apparatus according to Embodiment 1 of the present invention. FIG. 3(*a*) shows the directivity of the vertical (XZ) plane, and FIG. 3(*b*) shows the conical plane directivity with elevation angle θ of 70 degrees.

In FIG. 3(*a*), directivity 301*a* indicated by a solid line shows the directivity of a horizontally polarized wave (Eϕ) component when linear antenna elements are excited from feed point 106*a* and feed point 106*b* is shorted, and it can be confirmed that a main beam tilted in a direction in which elevation angle θ is 70 degrees is obtained. Directivity 301*b* indicated by a dotted line shows the directivity of a horizontally polarized wave (Eϕ) component when linear antenna elements are excited from feed point 106*b* and feed point 106*a* is shorted, and it can be confirmed that a main beam tilted in a direction in which elevation angle θ is 70 degrees is obtained.

In FIG. 3(*b*), directivity 302*a* indicated by a solid line shows the directivity of a horizontally polarized wave (Eϕ) component when linear antenna elements are excited from feed point 106*a* and feed point 106*b* is shorted, as in the case of directivity 301*a* in FIG. 3(*a*), and it can be confirmed that the main beam is directed toward the +X direction. Directivity 302*b* indicated by a dotted line shows the directivity of a horizontally polarized wave (Eϕ) component when linear antenna elements are excited from feed point 106*b* and feed point 106*a* is shorted, as in the case of directivity 301*b* in FIG. 3(*a*), and it can be confirmed that the main beam is directed toward the −X direction. At this time, for both directivity 302*a* and directivity 302*b*, the main beam directional gain is 14 dBi, the conical plane half-power beam width is 20 degrees, and the F/B ratio (ratio of main beam to back lobe) is 11 dB.

Here, since Non-Patent Document 1 discloses that the directional gain of a detour element loaded loop antenna is 10.5 dB and its conical plane half-power beam width is approximately 60 degrees, it can be seen that higher gain and narrower directivity can be achieved by connecting rhombic antenna sections in an array configuration like the antenna apparatus shown in Embodiment 1.

Figure 4:
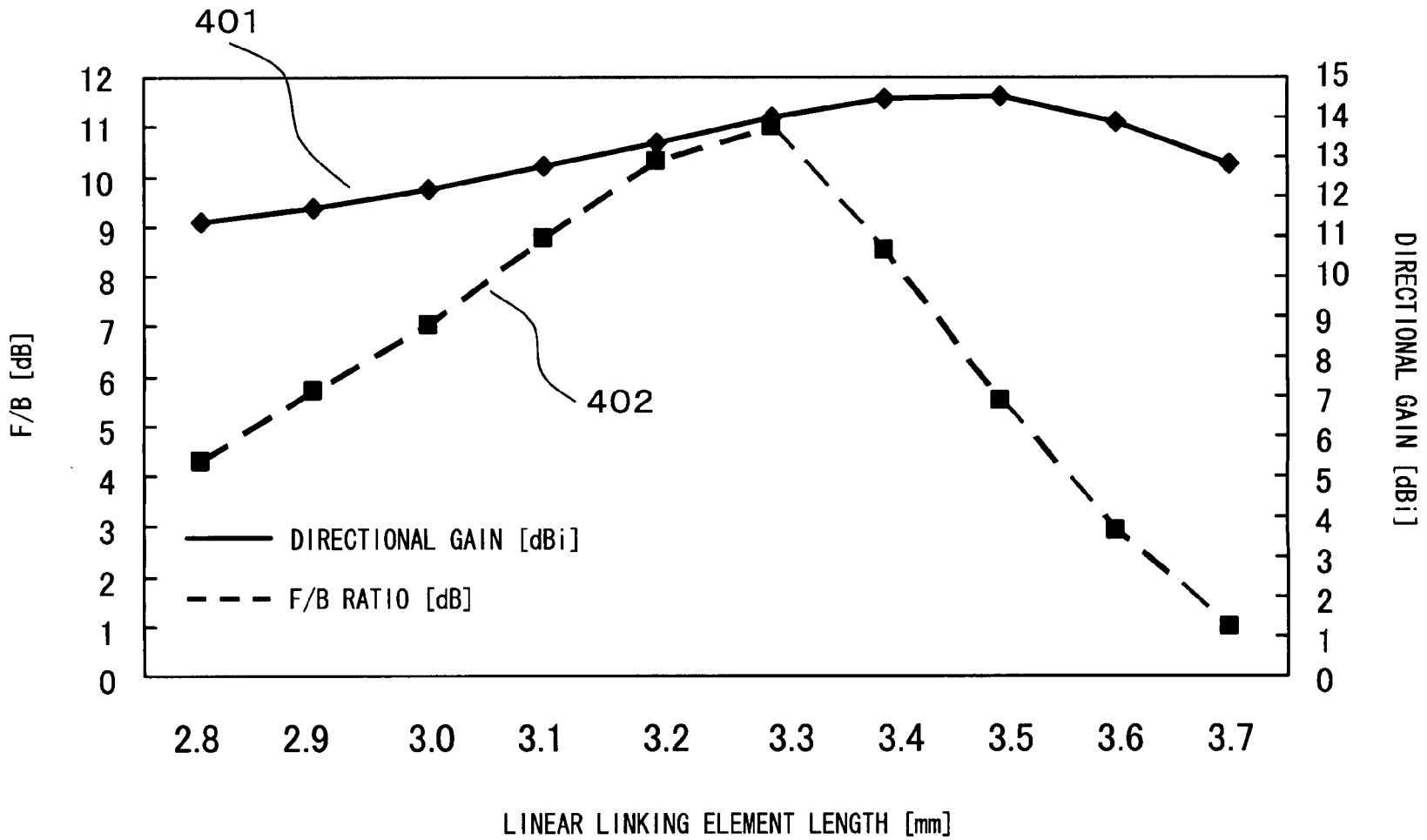
FIG. 4 is a drawing showing the F/B ratio and directional gain when the linear linking element length is varied.

FIG. 4 is a drawing showing the relationship between directional gain and the F/B ratio when the length of linear linking elements 104*a* through 104*d* is varied between 2.8 mm and 3.7 mm. From this figure, it can be confirmed that the variation width of directional gain 401 is small, while the variation width of F/B ratio 402 is large. It can thus be confirmed that the length of linear linking elements 104*a* through 104*d* at which directional gain 401 reaches 12.5 dBi or above and F/B ratio 402 reaches 8 dB or above is between 3.1 mm (approximately 0.36 wavelength) and 3.4 mm (approximately 0.40 wavelength.)

Thus, according to this embodiment, by connecting rhombic antenna sections in an array configuration and arranging a plate reflector at a predetermined distance from the linear antenna elements, it is possible to achieve higher gain and narrower directivity with a small, planar configuration suitable for an antenna for road-to-vehicle communication or vehicle-to-vehicle communication. Also, by switching between two feed points, it is possible to switch the main beam in two directions, thereby improving transmission quality by switching the beam in accordance with the vehicle driving condition. Furthermore, since operation is possible by feeding one linear antenna element point, compared to a complex array configuration using distribution feeding, it is possible to achieve high space-efficiency of the antenna apparatus and reduce feed loss.

In this embodiment, a case has been described in which detour elements of a 3-element detour element loaded loop antenna are connected, but any number of elements may be used within the scope of the above described operating principles.

Also, in this embodiment, a case has been described in which rhombic antenna elements are connected, but a similar effect can also be obtained with circular antenna elements.

Embodiment 2

Figure 5:
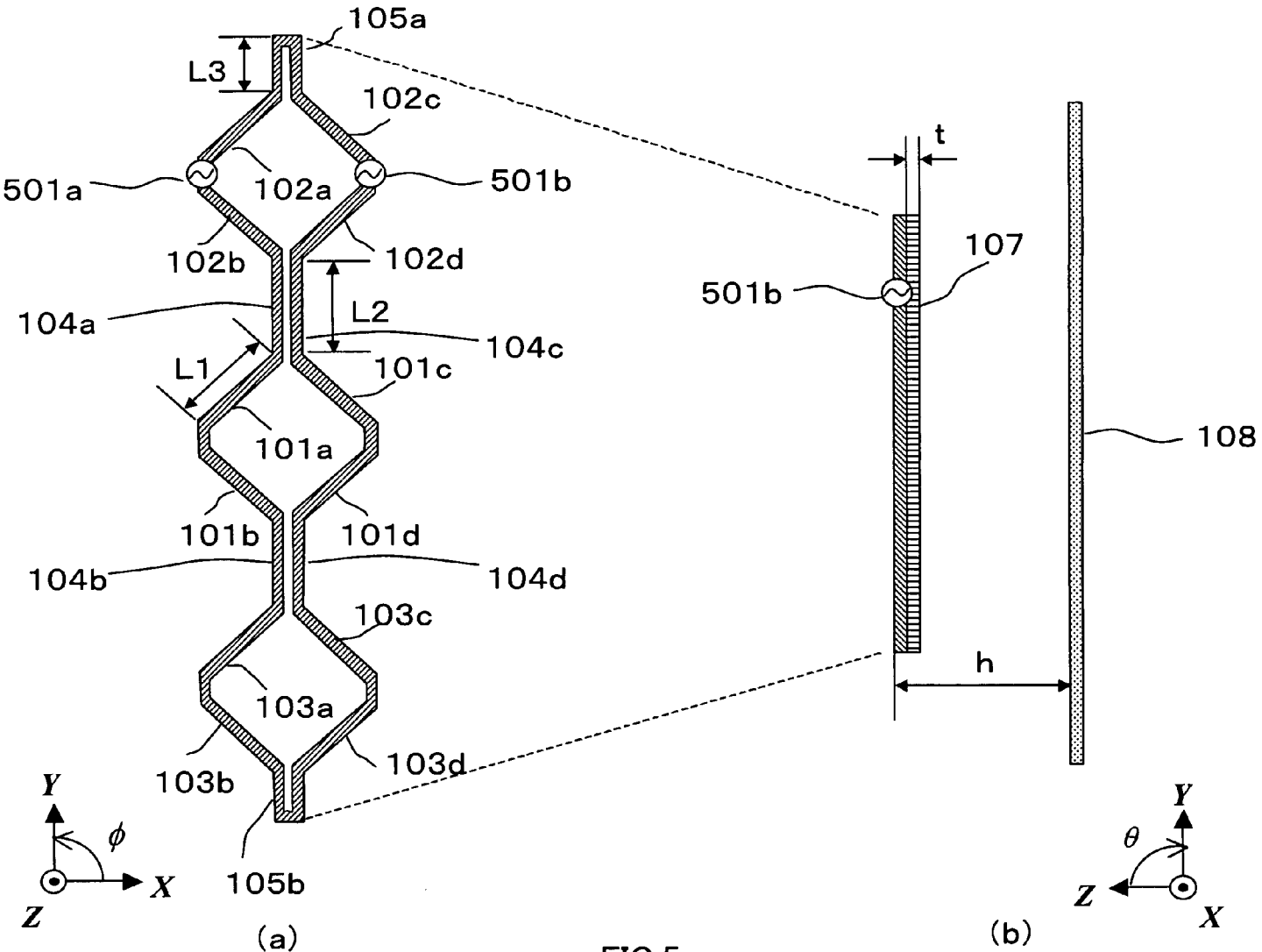
FIG. 5 is a configuration diagram in which feed points are provided in a rhombic antenna section on the +Y side in an antenna apparatus according to Embodiment 2 of the present invention.

FIG. 5 is a drawing showing the configuration of an antenna apparatus according to Embodiment 2 of the present invention. FIG. 5(*a*) is a planar view showing the configuration of the antenna apparatus, and FIG. 5(*b*) is an arrow view showing the configuration of the antenna apparatus viewed from the +X side of FIG. 5(*a*). In these figures, parts common to FIG. 1 are assigned the same reference numerals as in FIG. 1 without further explanations. Below, a case will be described in which an antenna is created on a dielectric substrate of, for example, $\epsilon r$=2.26, assuming that its operating frequency is 25 GHz and one wavelength (one effective wavelength) is 8.6 mm. The coordinate axes shown in the figures are defined for convenience of explanation.

Feed point 501*a* is provided between linear elements 102*a* and 102*b*, and feed point 501*b* is provided between linear elements 102*c* and 102*d*. Linear elements 101*a* and 101*b*, linear elements 101*c* and 101*d*, linear elements 103*a* and 103*b*, and linear elements 103*c* and 103*d*, are connected.

When linear antenna elements are excited from feed point 501*a*, feed point 501*b* is shorted, and linear elements 102*c* and 102*d* operate so as to be connected. Conversely, when linear antenna elements are excited from feed point 501*b*, feed point 501*a* is shorted, and linear elements 102*a* and 102*b* operate so as to be connected. In this way, by switching feed points and exciting linear antenna elements, it is possible to switch the main beam in two directions with one linear antenna element.

Figure 6:
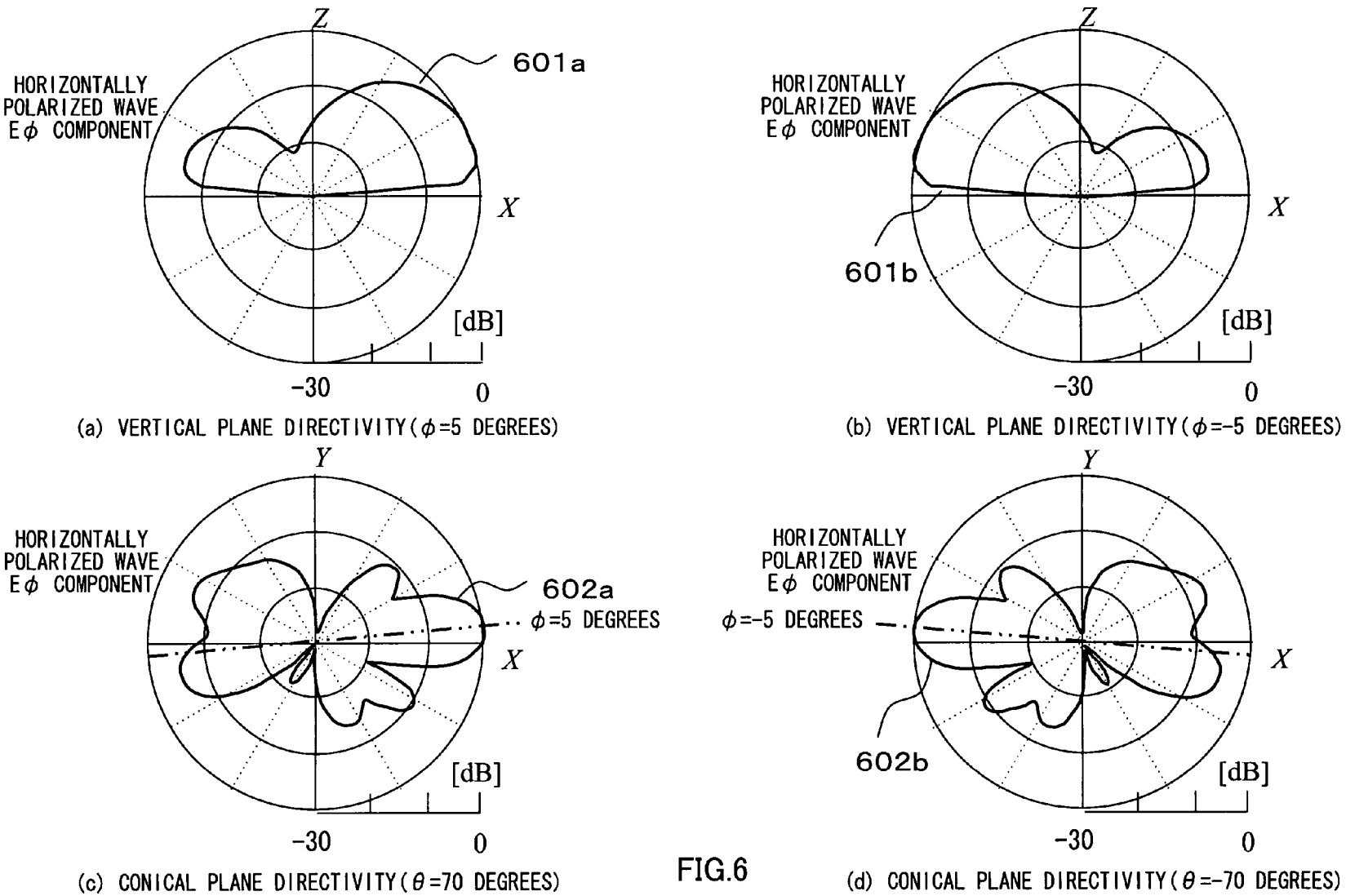
FIG. 6 is a drawing showing the directivity when feed points are provided in a rhombic antenna section on the +Y side.

FIG. 6(*a*) shows the vertical plane directivity when linear antenna elements are excited from feed point 501*a* and feed point 501*b* is shorted ($\phi$=5 degrees). FIG. 6(*b*) shows the vertical plane directivity when linear antenna elements are excited from feed point 501*b* and feed point 501*a* is shorted ($\phi$=−5 degrees). FIG. 6(*c*) shows the conical plane directivity with elevation angle $\theta$ of 70 degrees when linear antenna elements are excited from feed point 501*a* and feed point 501*b* is shorted. FIG. 6(*d*) shows the conical plane directivity with elevation angle $\theta$ of 70 degrees when linear antenna elements are excited from feed point 501*b* and feed point 501*a* is shorted.

In FIG. 6(*a*), directivity 601*a* shows the directivity of a horizontally polarized wave (E$\phi$) component, and it can be confirmed that a main beam tilted in a direction in which elevation angle $\theta$ is 70 degrees is obtained when $\phi$ is 5 degrees. In FIG. 6(*b*), directivity 601*b* shows the directivity of a horizontally polarized wave (E$\phi$) component, and it can be confirmed that a main beam tilted in a direction in which elevation angle $\theta$ is 70 degrees is obtained when $\phi$ is −5 degrees.

In FIG. 6(*c*), directivity 602*a* shows the directivity of a horizontally polarized wave (E$\phi$) component, as in the case of directivity 601*a* in FIG. 6(*a*), and it can be confirmed that the main beam is directed toward the direction in which $\phi$ is 5 degrees. Directivity 602*b* shown in FIG. 6(*d*) shows the directivity of a horizontally polarized wave (E$\phi$) component, as in the case of directivity 601*b* in FIG. 6(*b*), and it can be confirmed that the main beam is directed toward the direction in which $\phi$ is −5 degrees. At this time, for both directivity 602*a* and directivity 602*b*, the main beam directional gain is 13.2 dBi, the conical plane half-power beam width is 21 degrees, and the F/B ratio is 7 dB.

Figure 7:
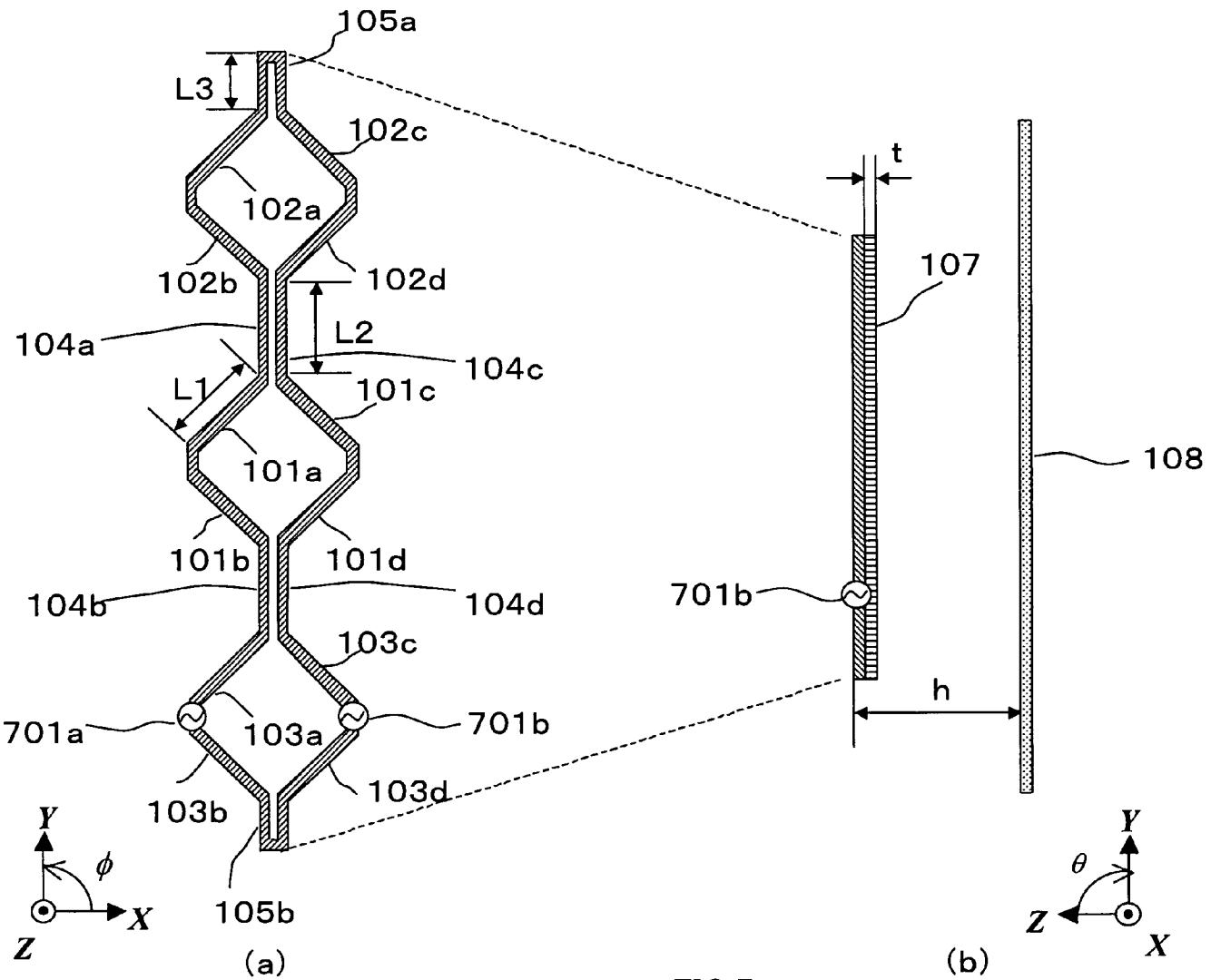
FIG. 7 is a configuration diagram in which feed points are provided in a rhombic antenna section on the −Y side in an antenna apparatus according to Embodiment 2 of the present invention.

FIG. 7 is a drawing showing another configuration of an antenna apparatus according to Embodiment 2 of the present invention. FIG. 7(*a*) is a planar view showing the configuration of the antenna apparatus, and FIG. 7(*b*) is an arrow view showing the configuration of the antenna apparatus viewed from the +X side of FIG. 7(*a*). In these figures, parts common to FIG. 1 are assigned the same reference numerals as in FIG. 1 without further explanations. Below, a case will be described in which an antenna is created on a dielectric substrate of $\epsilon r$=2.26, assuming that its operating frequency is 25 GHz and one wavelength (one effective wavelength) is 8.6 mm. The coordinate axes shown in the figures are defined for convenience of explanation.

When linear antenna elements are excited from feed point 701*a*, feed point 701*b* is shorted, and linear elements 103*c* and 103*d* operate so as to be connected. Conversely, when linear antenna elements are excited from feed point 701*b*, feed point 701*a* is shorted, and linear elements 103*a* and 103*b* operate so as to be connected. In this way, by switching feed points and exciting linear antenna elements, it is possible to switch the main beam in two directions with one linear antenna element.

Figure 8:
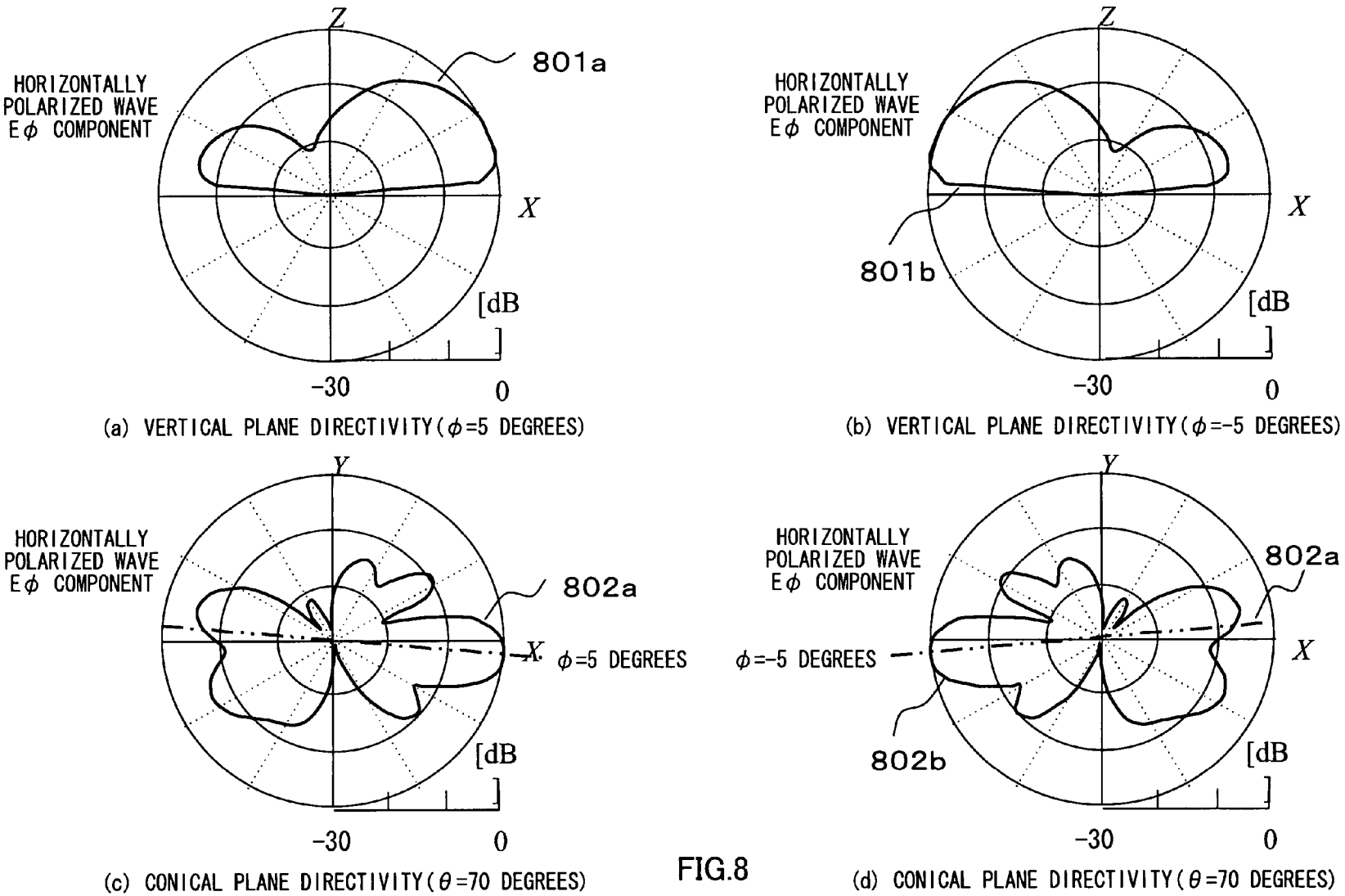
FIG. 8 is a drawing showing the directivity when feed points are provided in a rhombic antenna section on the −Y side.

FIG. 8 is a drawing showing the directivity of the antenna apparatus according to Embodiment 2 of the present invention shown in FIG. 7. FIG. 8(*a*) shows the vertical plane directivity when linear antenna elements are excited from feed point 701*a* and feed point 701*b* is shorted ($\phi$=−5 degrees). FIG. 8(*b*) shows the vertical plane directivity when linear antenna elements are excited from feed point 701*b* and feed point 701*a* is shorted ($\phi$=5 degrees). FIG. 8(*c*) shows the directivity of a conical plane with elevation angle $\theta$ of 70 degrees when linear antenna elements are excited from feed point 701*a* and feed point 701*b* is shorted. FIG. 8(*d*) shows the directivity of a conical plane with elevation angle $\theta$ of 70 degrees when linear antenna elements are excited from feed point 701*b* and feed point 701*a* is shorted.

In FIG. 8(*a*), directivity 801*a* shows the directivity of a horizontally polarized wave (E$\phi$) component, and it can be confirmed that a main beam tilted in a direction in which elevation angle $\theta$ is 70 degrees is obtained when $\phi$ is −5 degrees. In FIG. 8(*b*), directivity 801*b* shows the directivity of a horizontally polarized wave (E$\phi$) component, and it can be confirmed that a main beam tilted in a direction in which elevation angle $\theta$ is 70 degrees is obtained when $\phi$ is 5 degrees.

In FIG. 8(*c*), directivity 802*a* shows the directivity of a horizontally polarized wave (E$\phi$) component, as in the case of directivity 801*a* in FIG. 8(*a*), and it can be confirmed that the main beam is directed toward the direction in which $\phi$ is −5 degrees. Directivity 802*b* shown in FIG. 8(*d*) shows the directivity of a horizontally polarized wave (E$\phi$) component, as in the case of directivity 801*b* in FIG. 8(*b*), and it can be confirmed that the main beam is directed toward the direction in which $\phi$ is 5 degrees. At this time, for both directivity 802*a* and directivity 802*b*, the main beam directional gain is 13.2 dBi, the conical plane half-power beam width is 21 degrees, and the F/B ratio is 7 dB.

Thus, according to this embodiment, by employing a configuration in which feed points are arranged asymmetrically with respect to the linear antenna elements and two feed points are switched, it is possible not only to switch the main beam direction but also to tilt the beam in the conical plane.

Embodiment 3

Figure 9:
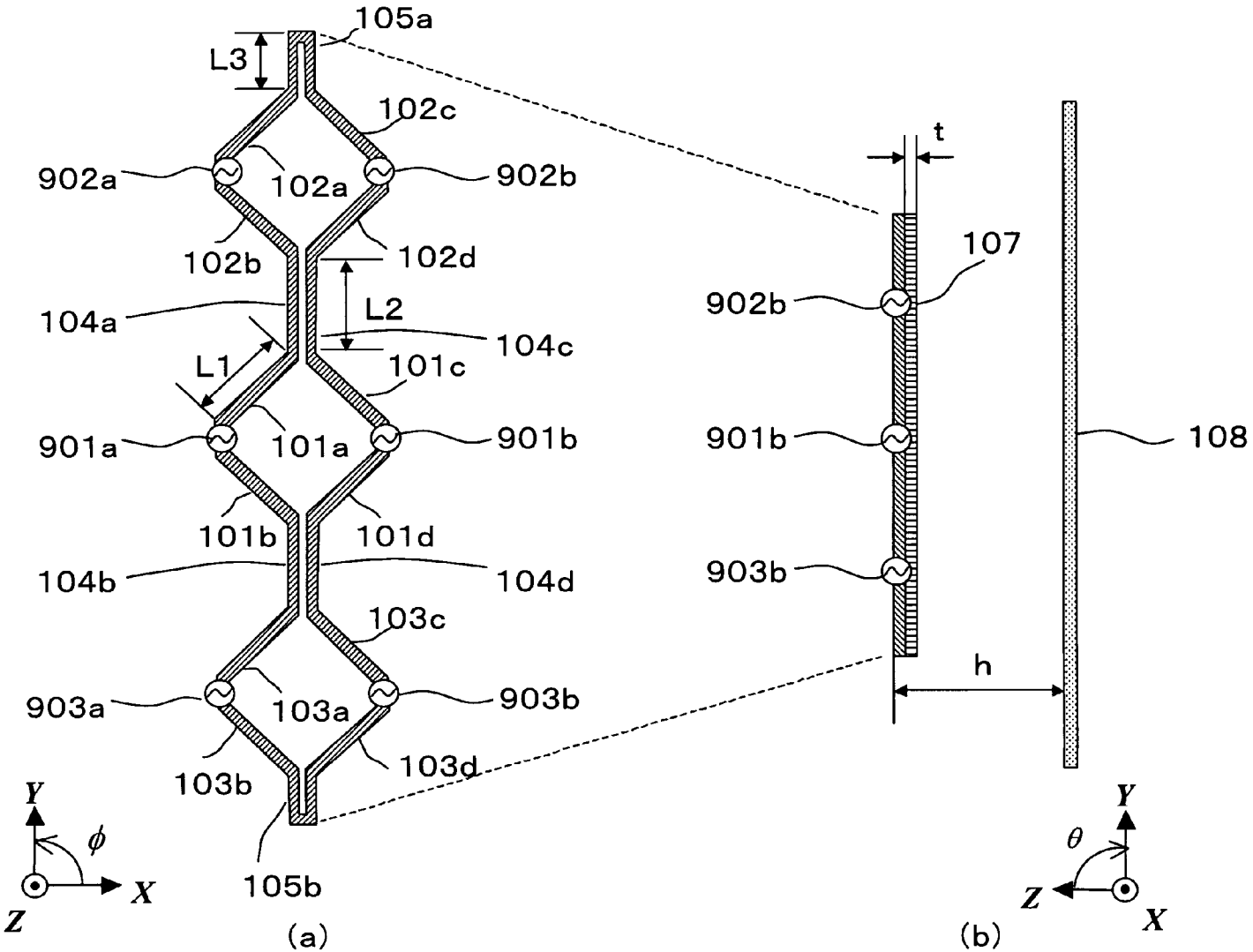
FIG. 9 is a configuration diagram of an antenna apparatus according to Embodiment 3 of the present invention.

FIG. 9 is a drawing showing the configuration of an antenna apparatus according to Embodiment 3 of the present invention. FIG. 9(*a*) is a planar view showing the configuration of the antenna apparatus, in which feed points 901*a*, 901*b*, 902*a*, 902*b*, 903*a* and 903*b* are provided at the peaks opposite to the respective rhombic antenna sections, and the feed points are switched. FIG. 9(*b*) is an arrow view showing the configuration of the antenna apparatus viewed from the +X side of FIG. 9(*a*). In these figures, parts common to FIG. 1 are assigned the same reference numerals as in FIG. 1 without further explanations. Below, a case will be described in which an antenna is created on a dielectric substrate of, for example, $\epsilon r=2.26$, assuming that its operating frequency is 25 GHz and one wavelength (one effective wavelength) is 8.6 mm. The coordinate axes shown in the figures are defined for convenience of explanation.

Figure 10:
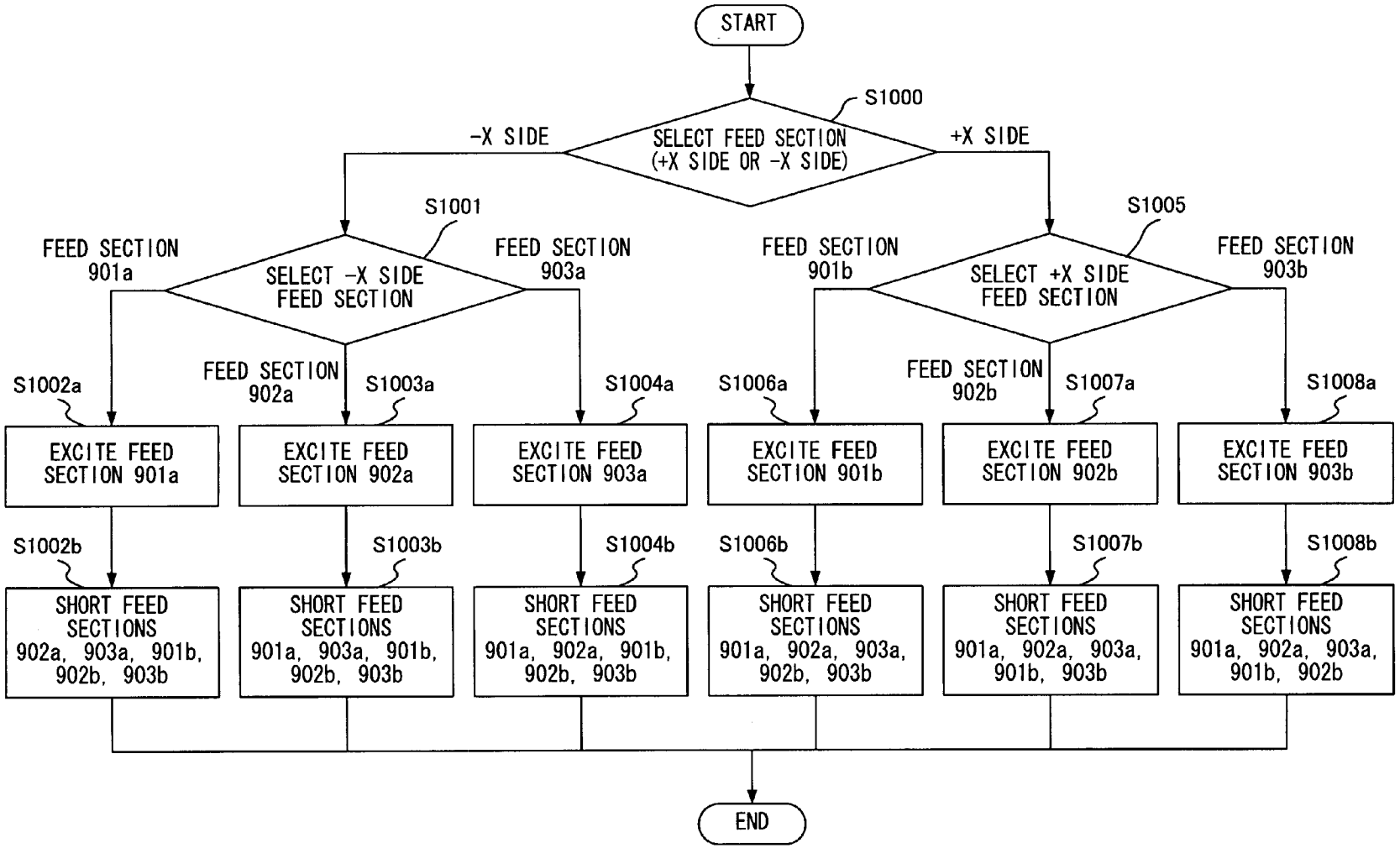
FIG. 10 is a flowchart showing switching operation of feed points of an antenna apparatus according to Embodiment 3 of the present invention.

An example of feed point switching according to an antenna apparatus of this embodiment will be described here using a flowchart shown in FIG. 10.

First, feeding power to either the −X side or the +X side of the antenna apparatus is selected (S1000). When the −X side is fed, the processing flow proceeds to S1001. In S1001, one of the −X side feed points is selected. If feed point 901*a* is selected here, feed point 901*a* is excited (S1002*a*). At this time, simultaneously, feed points 902*a*, 903*a*, 901*b*, 902*b* and 903*b* are shorted (S1002*b*). In this way, linear antenna elements are excited from feed point 901*a*, and the same effect is obtained as when feed point 106*a* is excited in Embodiment 1.

If, feed point 902*a* is selected, feed point 902*a* is excited (S1003*a*). At this time, feed points 901*a*, 903*a*, 901*b*, 902*b* and 903*b* are simultaneously shorted (S1003*b*). In this way, linear antenna elements are excited from feed point 902*a*, and the same effect is obtained as when feed point 501*a* is excited in Embodiment 2.

If feed point 903*a* is selected, feed point 903*a* is excited (S1004*a*). At this time, simultaneously, feed points 901*a*, 902*a*, 901*b*, 902*b* and 903*b* are shorted (S1004*b*) In this way, linear antenna elements are excited from feed point 903*a*, and the same effect is obtained as when feed point 701*a* is excited in Embodiment 2.

Next, the case where the +X side is fed will be considered. In S1005, one of the +X side feed points is selected. If feed point 901*b* is selected here, feed point 901*b* is excited (S1006*a*). At this time, feed points 901*a*, 902*a*, 903*a*, 902*b* and 903*b* are simultaneously shorted (S1006*b*). In this way, linear antenna elements are excited from feed point 901*b*, and the same effect is obtained as when feed point 106*b* is excited in Embodiment 1.

If feed point 902*b* is selected, feed point 902*b* is excited (S1007*a*). At this time, feed points 901*a*, 902*a*, 903*a*, 901*b* and 903*b* are simultaneously shorted (S1007*b*). In this way, linear antenna elements are excited from feed point 902*b*, and the same effect is obtained as when feed point 501*b* is excited in Embodiment 2.

If feed point 903*b* is selected, feed point 903*b* is excited (S1008*a*). At this time, feed points 901*a*, 902*a*, 903*a*, 901*b* and 902*b* are simultaneously shorted (S1008*b*). In this way, linear antenna elements are excited from feed point 903*b*, and the same effect is obtained as when feed point 701*b* is excited in Embodiment 2.

Thus, according to this embodiment, by providing a plurality of feed points and switching these, it is possible to switch the main beam direction in the vertical plane and conical plane.

Embodiment 4

Figure 11:
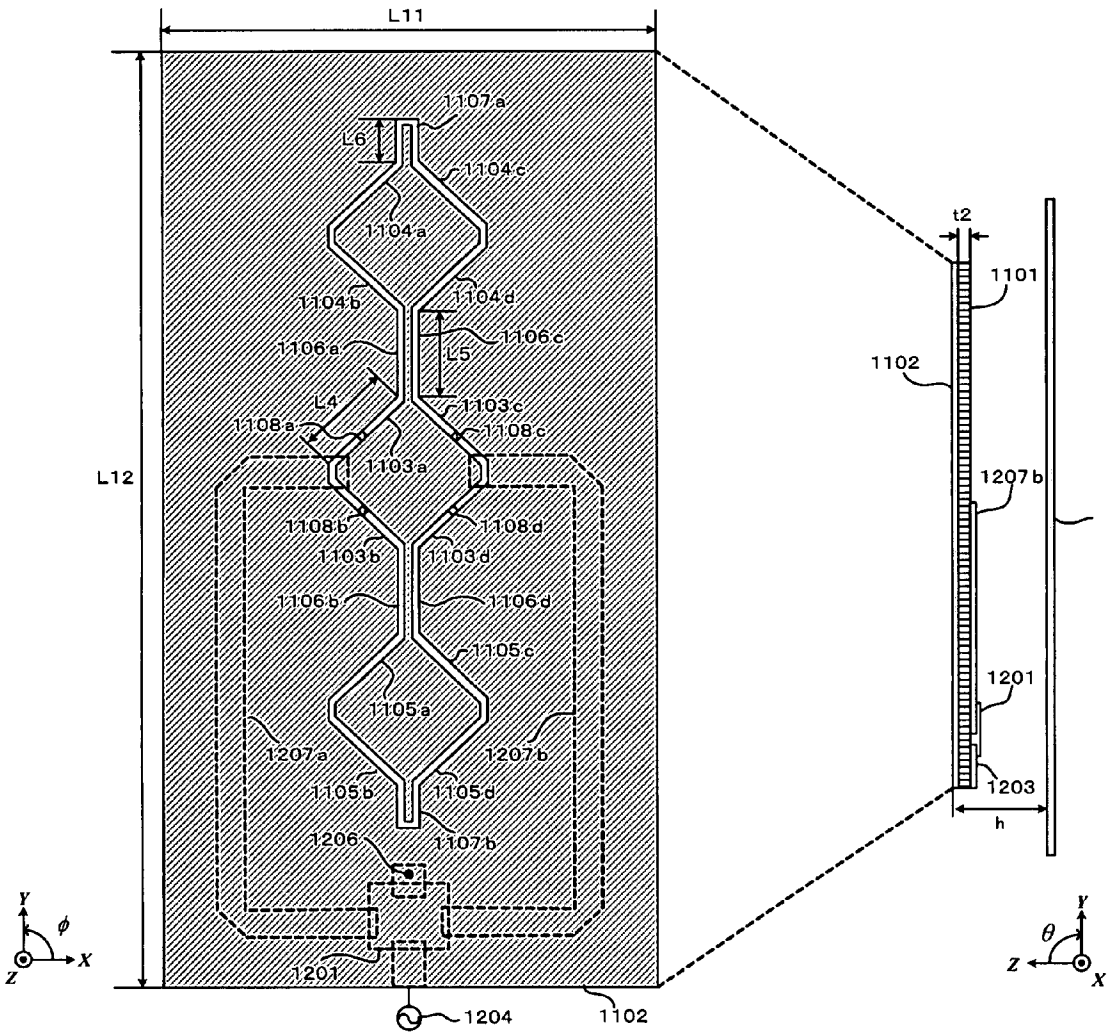
FIG. 11 is a configuration diagram of an antenna apparatus according to Embodiment 4 of the present invention.
Figure 12:
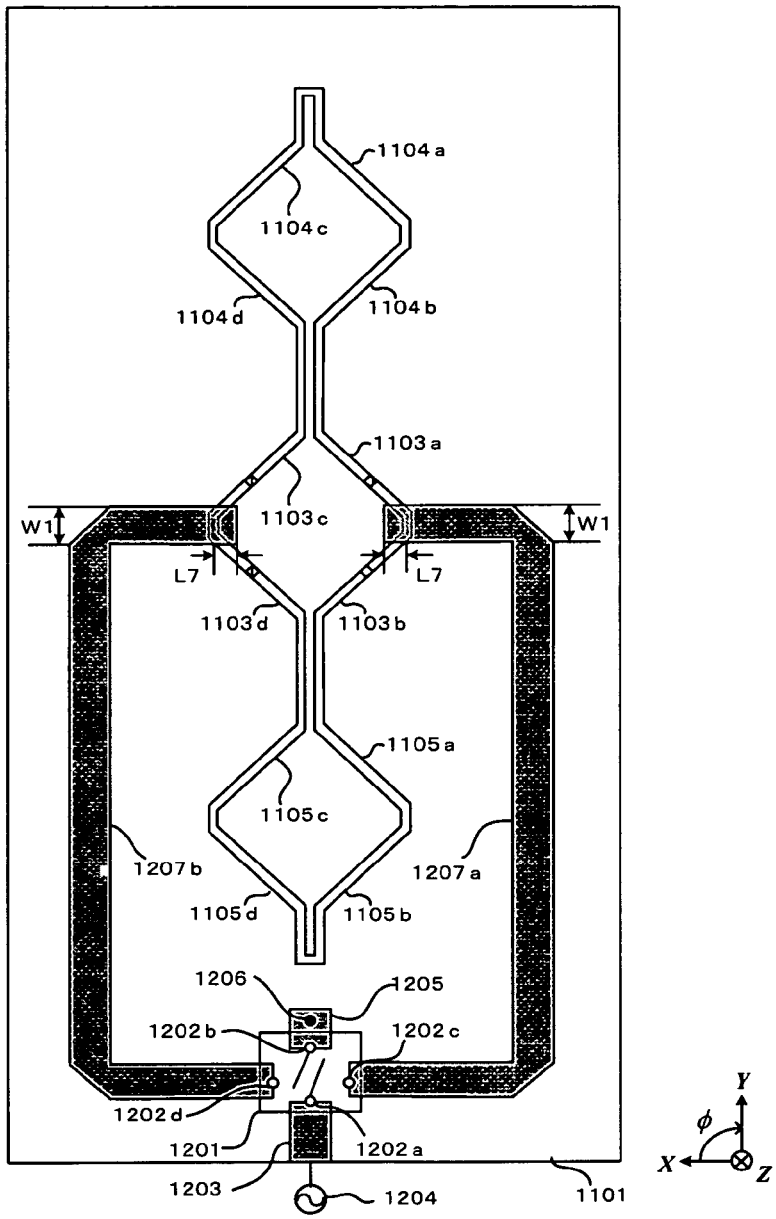
FIG. 12 is a planar view from the −Z side of an antenna apparatus according to Embodiment 4 of the present invention.

FIG. 11 and FIG. 12 are drawings showing the configuration of an antenna apparatus according to Embodiment 4 of the present invention. FIG. 11(*a*) is a planar view showing the antenna apparatus viewed from the +Z side, and FIG. 11(*b*) is an arrow view showing the antenna apparatus viewed from the +X side. FIG. 12 is a planar view of the antenna apparatus viewed from the −Z side, excluding plate reflector 108. In FIG. 11 and FIG. 12, parts common to FIG. 1 are assigned the same reference numerals as in FIG. 1 without further explanations. In the following description, the operating frequency is assumed to be 25 GHz. The coordinate axes shown in FIG. 11 and FIG. 12 are defined for convenience of explanation.

In FIG. 11, dielectric substrate 1101 has relative permittivity $\epsilon r$ of, for example, 3.45, and thickness t of approximately 0.04 wavelength (0.3 mm), and dimensions L11×L12 are 2 wavelengths×4.3 wavelengths (14.5 mm×31 mm.) At this time, one wavelength (one effective wavelength) is assumed to be 7.2 mm.

Copper foil layer 1102 is copper foil bonded to the +Z side of dielectric substrate 1101. Slot elements 1103*a* through 1103*d*, 1104*a* through 1104*d*, and 1105*a* through 1105*d*, are voids (copper foil patterns) formed by removing copper foil layer 1102, with element length L4 of approximately ⅓ wavelength (2.4 mm), and an element width of, for example, 0.2 mm. These slot elements 1103*a* through 1103*d*, 1104*a* through 1104*d*, and 1105*a* through 1105*d* are arranged in square shapes as shown in FIG. 11(*a*).

Slot linking elements 1106*a* through 1106*d*, and slot detour elements 1107*a* and 1107*b*, are also voids (copper foil patterns) formed by removing copper foil layer 1102, with element length L5 of approximately 0.43 wavelength (3.1 mm) and element length L6 of approximately 0.14 wavelength (1 mm) respectively, and an element width of, for example, 0.2 mm. Slot linking element 1106*a* connects slot elements 1103*a* and 1104*b*, slot linking element 1106*b* connects slot elements 1103*b* and 1105*a*, slot linking element 1106*c* connects slot elements 1103*c* and 1104*d*, and slot linking element 1106*d* connects slot elements 1103*d* and 1105*c*. Furthermore, slot detour element 1107*a* connects slot elements 1104*a* and 1104*c*, and slot detour element 1107*b* connects slot elements 1105*b* and 1105*d*. In addition, slot elements 1103*a* and 1103*b*, slot elements 1103*c* and 1103*d*, slot elements 1104*a* and 1104*b*, slot elements 1104*c* and 1104*d*, slot elements 1105*a* and 1105*b*, and slot elements 1105*c* and 1105*d*, are connected.

Connecting conductors 1108*a* through 1108*d* are formed in a square shape as a copper foil pattern, for example, in slot elements 1103*a* through 1103*d*, and the inner and outer copper foil layers of the slot elements are connected so that slot elements 1103*a* through 1103*d* are respectively divided approximately at their center. By dividing slot elements 1103*a* through 1103*d* by means of connecting conductors 1108*a* through 1108*d* in this way, it is possible to implement an antenna apparatus in which impedance matching is easily achieved and that has a good F/B ratio.

Slot antenna elements with rhombic slot antenna sections connected in an array configuration are configured with slot elements 1103*a* through 1103*d*, 1104*a* through 1104*d*, and 1105*a* through 1105*d*, slot linking elements 1106*a* through

1106*d*, slot detour elements 1107*a* and 1107*b*, and connecting conductors 1108*a* through 1108*d*, configured as described above.

Switch 1201 is a DPDT (Double Pole Double Throw) switch having two input terminals 1202*a* and 1202*b* and two output terminals 1202*c* and 1202*d*. This switch 1201 operates so that, when input terminal 1202*a* is connected to output terminal 1202*c*, input terminal 1202*b* and output terminal 1202*d* are connected, and when input terminal 1202*a* is connected to output terminal 1202*d*, input terminal 1202*b* and output terminal 1202*c* are connected.

Feed point 1204 is connected to input terminal 1202*a* via microstrip line 1203, and input terminal 1202*b* is connected to copper foil pattern 1205 and is grounded to copper foil layer 1102 which is a grounding conductor via through-hole 1206. Also, microstrip line 1207*a* is connected to output terminal 1202*c*, and microstrip line 1207*b* is connected to output terminal 1202*d*. Above described microstrip line 1203 and copper foil pattern 1205 are copper foil patterns formed on the −Z side of dielectric substrate 1101.

Microstrip line 1207*a* is formed by means of a copper foil pattern on the −Z side of dielectric substrate 1101, with one end arranged so as to pass through the junction of slot element 1103*a* and slot element 1103*b*, and the other end connected to output terminal 1202*c* of switch 1201. Similarly, microstrip line 1207*b* is formed by means of a copper foil pattern on the −Z side of dielectric substrate 1101, with one end arranged so as to pass through the junction of slot element 1103*c* and slot element 1103*d*, and the other end connected to output terminal 1202*d* of switch 1201.

Width W1 of microstrip lines 1207*a* and 1207*b* is set to 0.6 mm so that the characteristic impedance is 50Ω. Distance L7 from the end of microstrip line 1207*a* to the junction of slot element 1103*a* and slot element 1103*b*, and distance L7 from the end of microstrip line 1207*b* to the junction of slot element 1103*c* and slot element 1103*d*, are set to 0.45 mm.

As the antenna apparatus of this embodiment shown in FIG. 11 and FIG. 12 can be considered to be substantially equivalent to the antenna apparatus shown in FIG. 1 with the linear elements replaced by slot elements, its operation can be explained by substituting magnetic fields for electrical fields. Therefore, whereas the main polarized wave component of the antenna apparatus shown in FIG. 1 is a horizontal (Eϕ) component, the main polarized wave component of the antenna apparatus shown in FIG. 11 and FIG. 12 is a vertical (Eθ) component.

The operation in an antenna apparatus with the above described configuration when the antenna apparatus is excited from microstrip line 1207*a* will now be explained. A signal excited from feed point 1204 is inputted to input terminal 1202*a* of switch 1201. At this time, switch 1201 operates so that input terminal 1202*a* and output terminal 1202*c*, and input terminal 1202*b* and output terminal 1202*d*, are connected respectively. Thus, the signal inputted to input terminal 1202*a* is inputted to microstrip line 1207*a* via output terminal 1202*c*.

On the other hand, microstrip line 1207*b* is grounded via input terminal 1202*b* and output terminal 1202*d*. Since the antenna elements are configured with slot elements, if magnetic fields are considered to be substituted for the electrical fields in the case of linear elements, it is necessary to create an open state at the junction of microstrip line 1207*b* and a slot element, that is, to ground the other end of microstrip line 1207*b*. Therefore, the length from the junction of microstrip line 1207*b* and a slot element to the grounding point—that is, the overall electrical length of microstrip line 1207*b*, copper foil pattern 1205, through-hole 1206, and switch 1201—must be set to an odd multiple of ¼ wavelength. By this means, it is possible to achieve high directional gain and a good F/B ratio.

Similarly, when the antenna apparatus is excited from microstrip line 1207*b*, switch 1201 operates so that input terminal 1202*a* and output terminal 1202*d*, and input terminal 1202*b* and output terminal 1202*c*, are connected respectively. At this time, it is necessary to create an open state at the junction of microstrip line 1207*a* and a slot element, and therefore the length from the junction of microstrip line 1207*a* and a slot element to the grounding point must be set to an odd multiple of ¼ wavelength.

Figure 13:
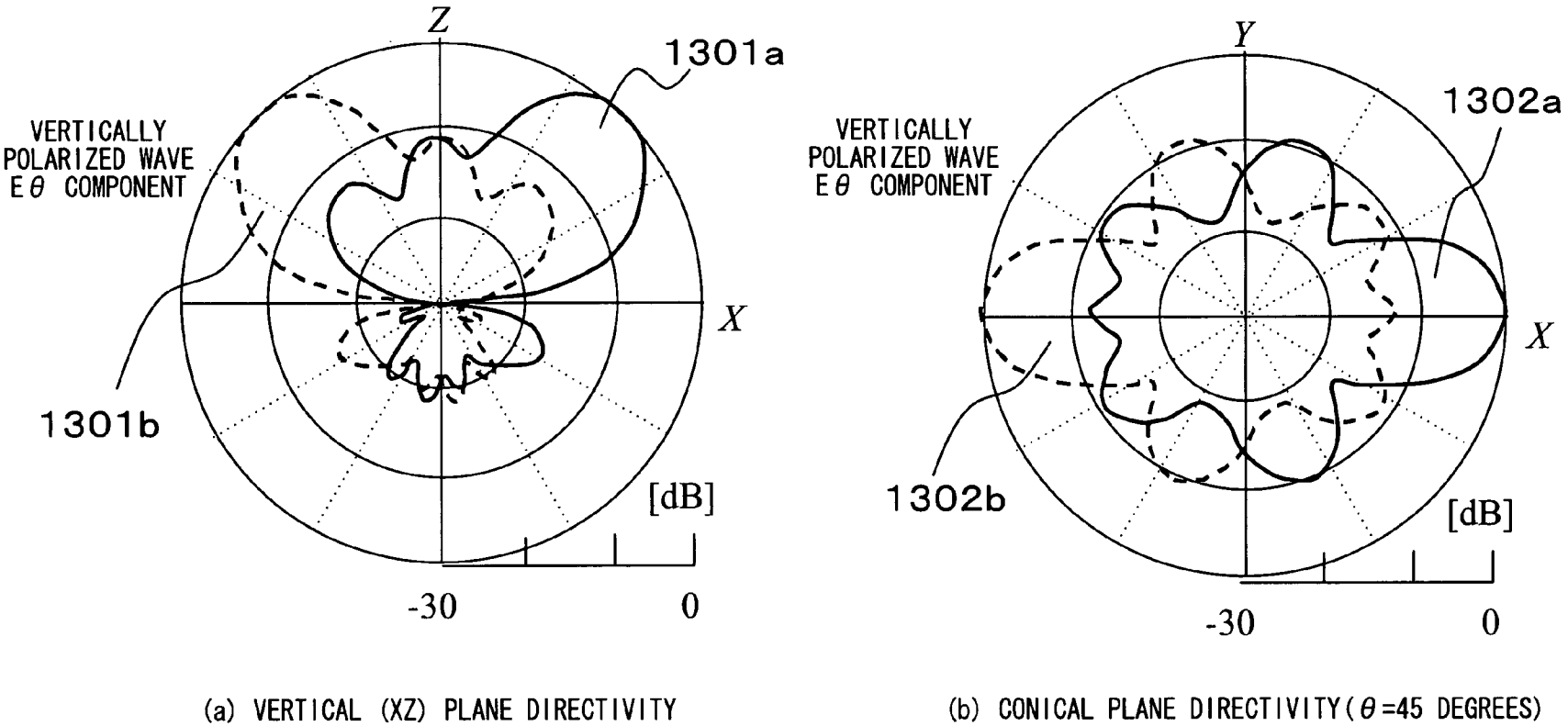
FIG. 13 is a drawing showing the directivity of an antenna apparatus according to Embodiment 4 of the present invention.

FIG. 13 is a drawing showing the directivity of an antenna apparatus according to Embodiment 4 of the present invention. FIG. 13(*a*) shows the directivity of the vertical (XZ) plane, and FIG. 13(*b*) shows the conical plane directivity with elevation angle θ of 45 degrees.

In FIG. 13(*a*), directivity 1301*a* indicated by a solid line shows the directivity of a vertically polarized wave (Eθ) component when the antenna apparatus is excited from microstrip line 1207*a*, and it can be confirmed that a main beam tilted in a direction in which elevation angle θ is 45 degrees is obtained. Directivity 1301*b* indicated by a dotted line shows the directivity of a vertically polarized wave (Eθ) component when the antenna apparatus is excited from microstrip line 1207*b*, and it can be confirmed that a main beam tilted in a direction in which elevation angle θ is 45 degrees is obtained.

In FIG. 13(*b*), directivity 1302*a* indicated by a solid line shows the directivity of a vertically polarized wave (Eθ) component when the antenna apparatus is excited from microstrip line 1207*a*, as in the case of directivity 1301*a* in FIG. 13(*a*), and it can be confirmed that the main beam is directed toward the +X direction. Directivity 1302*b* indicated by a dotted line shows the directivity of a vertically polarized wave (Eθ) component when the antenna apparatus is excited from microstrip line 1207*b*, as in the case of directivity 1301*b* in FIG. 13(*a*), and it can be confirmed that the main beam is directed toward the −X direction. At this time, for both directivity 1302*a* and directivity 1302*b*, the main beam directional gain is 13.54 dBi, the conical plane half-power beam width is 27 degrees, and the F/B ratio is 11.2 dB.

Thus, according to this embodiment, it is possible to implement an antenna apparatus in which impedance matching and power feeding are simplified using microstrip lines. Furthermore, it is possible to switch the main beam in two directions by switching the power feeding to the microstrip lines using a switching circuit.

In this embodiment, slot elements are formed by means of copper foil patterns on a dielectric substrate, but a similar effect can also be obtained, for example, if slot elements are formed by providing voids in a conductive plate.

In this embodiment, connecting conductors have been described as being formed as copper foil patterns within slot elements, and connecting the inner copper foil layer and outer copper foil layer within slot elements so that the slot elements are divided approximately at their center, but a similar effect can also be obtained if connecting conductors are formed in the same plane as the microstrip lines, and connect the inner copper foil layer and outer copper foil layer via a through-hole.

In this embodiment, a configuration has been described in which connecting conductors are provided only in the center rhombic slot antenna section, but connecting conductors may also be provided in the rhombic slot antenna sections at both ends.

In this embodiment, a configuration has been described in which connecting conductors are provided only in the center rhombic slot antenna section, but connecting conductors may also be provided in a plurality of rhombic slot antenna sections.

In this embodiment, a case has been described in which a single DPDT switch is used as a switch, but a plurality of switches may also be used, as in a configuration, for example, using three SPDT (Single Pole Double Throw) switches, for example.

In this embodiment, a case has been described in which one terminal of a switch is grounded, and the length from the junction of a microstrip line and slot element to the grounding point is made an odd multiple of ¼ wavelength, but high directional gain and a good F/B ratio can also be achieved with a configuration in which, for example, one terminal of the switch is left open, and the length from the junction of a microstrip line and slot element to the grounding point is made an integral multiple of ½ wavelength.

Embodiment 5

Figure 14:
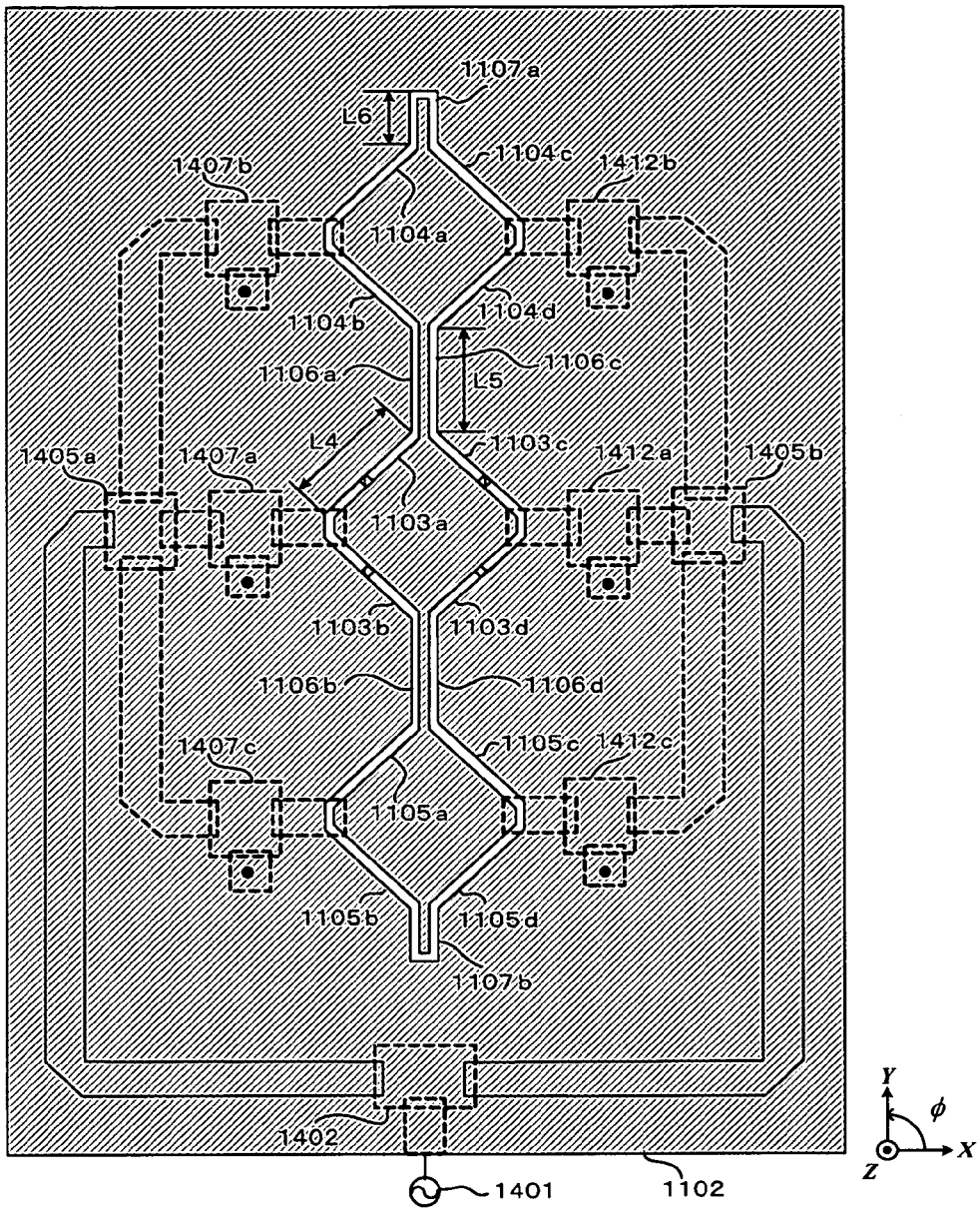
FIG. 14 is a planar view from the +Z side of an antenna apparatus according to Embodiment 5 of the present invention.
Figure 15:
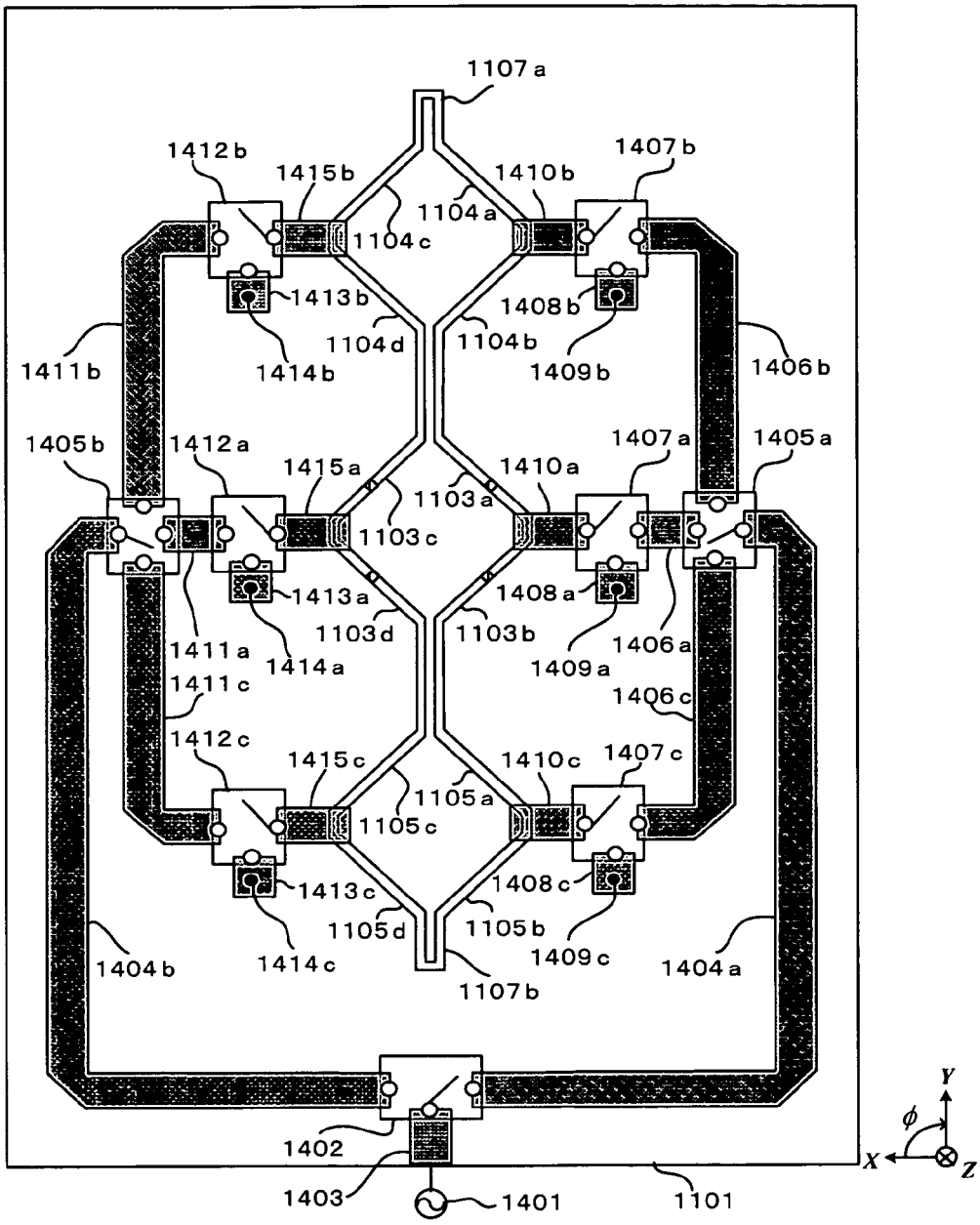
FIG. 15 is a planar view from the −Z side of an antenna apparatus according to Embodiment 5 of the present invention.

FIG. 14 and FIG. 15 are drawings showing the configuration of an antenna apparatus according to Embodiment 5 of the present invention. FIG. 14 is a planar view showing the antenna apparatus viewed from the +Z side, and FIG. 15 is a planar view from the −Z side, excluding the plate reflector. In FIG. 14 and FIG. 15, parts common to FIG. 11 are assigned the same reference numerals as in FIG. 11 without further explanations. Although not shown in these figures, plate reflector 108 is arranged approximately parallel to, and at a predetermined distance from, the dielectric substrate. In the following description, the operating frequency is assumed to be 25 GHz. The coordinate axes shown in FIG. 14 and FIG. 15 are defined for convenience of explanation.

Switch 1402 is an SPDT (Single Pole Double Throw) switch having one input terminal and two output terminals. The input terminal is connected to feed point 1401 via microstrip line 1403, and the two output terminals are connected to microstrip lines 1404*a* and 1404*b*. Microstrip line 1403 and microstrip lines 1404*a* and 1404*b* are copper foil patterns formed on the −Z side of dielectric substrate 1101.

Switches 1405*a* and 1405*b* are SP3T (Single Pole 3 Throw) switches having one input terminal and three output terminals. In switch 1405*a*, the input terminal is connected to microstrip line 1404*a*, and the three output terminals are connected to microstrip lines 1406*a* through 1406*c* respectively. Microstrip lines 1406*a* through 1406*c* are copper foil patterns formed on the −Z side of dielectric substrate 1101. In switch 1405*b*, the input terminal is connected to microstrip line 1404*b*, and the three output terminals are connected to microstrip lines 1411*a* through 1411*c* respectively. Microstrip lines 1411*a* through 1411*c* are also copper foil patterns formed on the −Z side of dielectric substrate 1101.

Switches 1407*a* through 1407*c* are SPDT (Single Pole Double Throw) switches having one input terminal and two output terminals. In switch 1407*a*, the input terminal is connected to microstrip line 1406*a*, and the two output terminals are connected to copper foil pattern 1408*a* and microstrip line 1410*a*. Copper foil pattern 1408*a* is grounded to grounding conductor 1102 via through-hole 1409*a*. In switch 1407*b*, the input terminal is connected to microstrip line 1406*b*, and the two output terminals are connected to copper foil pattern 1408*b* and microstrip line 1410*b*. Copper foil pattern 1408*b* is grounded to grounding conductor 1102 via through-hole 1409*b*. In switch 1407*c*, the input terminal is connected to microstrip line 1406*c*, and the two output terminals are connected to copper foil pattern 1408*c* and microstrip line 1410*c*. Copper foil pattern 1408*c* is grounded to grounding conductor 1102 via through-hole 1409*c*. Copper foil patterns 1408*a* through 1408*c* and microstrip lines 1410*a* through 1410*c* are copper foil patterns formed on the −Z side of dielectric substrate 1101.

Similarly, switches 1412*a* through 1412*c* are also SPDT (Single Pole Double Throw) switches having one input terminal and two output terminals. In switches 1412*a* through 1412*c*, the input terminal is respectively connected to microstrip line 1411*a*, 1411*b* and 1411*c*, and the two output terminals are respectively connected to copper foil pattern 1413*a* and a microstrip line 1415*a*, copper foil pattern 1413*b* and microstrip line 1415*b*, and copper foil pattern 1413*c* and microstrip line 1415*c*. Copper foil patterns 1413*a* through 1413*c* are grounded to grounding conductor 1102 via through-holes 1414*a* through 1414*c*. Copper foil patterns 1413*a* through 1413*c* and microstrip lines 1415*a* through 1415*c* are copper foil patterns formed on the −Z side of dielectric substrate 1101.

Figure 16:
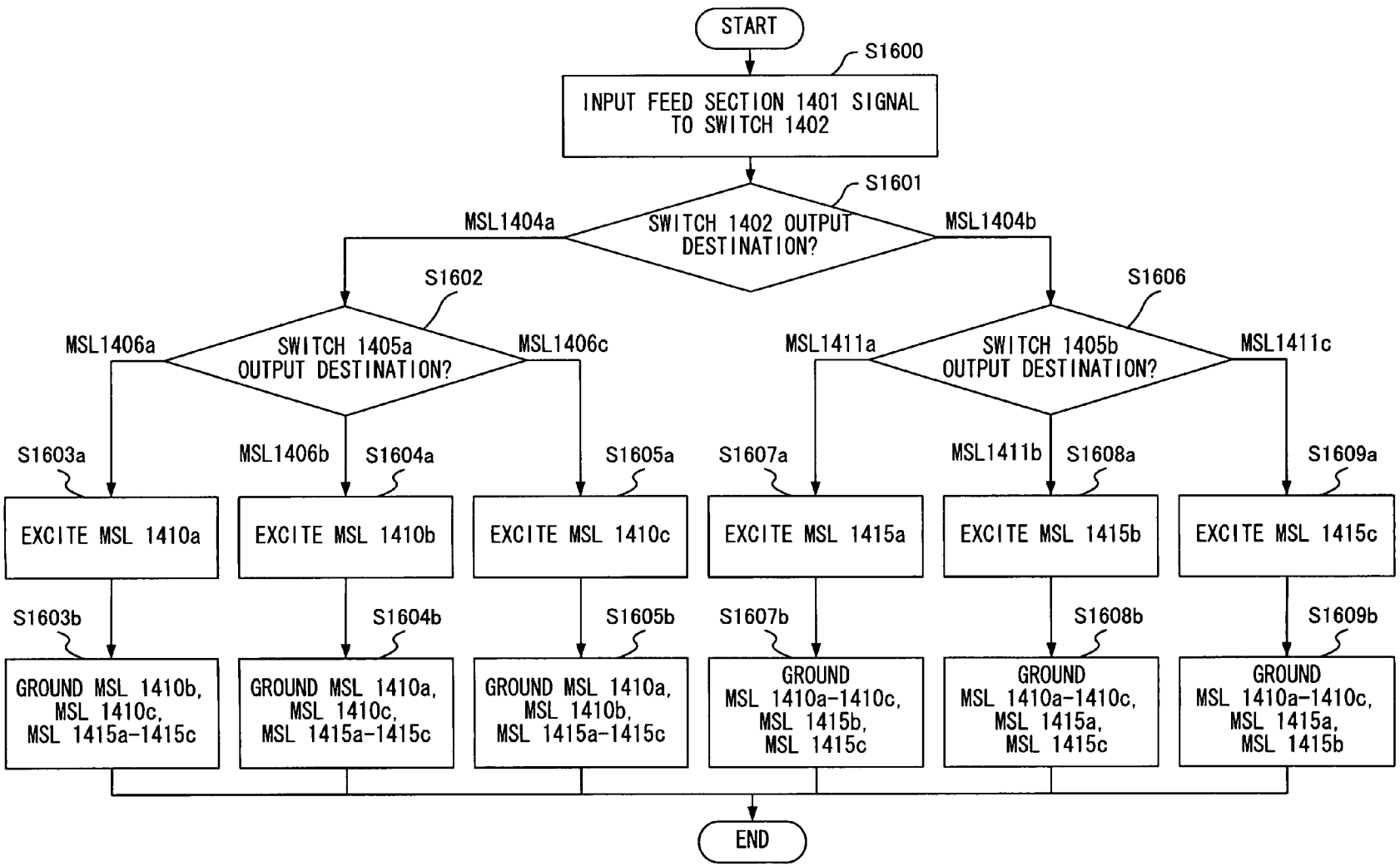
FIG. 16 is a flowchart showing switching operation of feed points of an antenna apparatus according to Embodiment 5 of the present invention.

Power feeding to the antenna apparatus accompanying the switching circuit operation in the antenna apparatus configured as described above will now be explained using the flowchart in FIG. 16.

First, a signal of feed point 1401 is inputted to switch 1402 (S1600). Then the output destination of switch 1402 is determined (S1601). If the output terminal of switch 1402 is connected to microstrip line 1404*a*, the processing flow proceeds to S1602. In S1602, the output destination of switch 1405*a* is determined. If the output terminal of switch 1405*a* is connected to microstrip line 1406*a*, microstrip line 1410*a* is excited (S1603*a*). At this time, microstrip lines 1410*b*, 1410*c*, and 1415*a* through 1415*c* are simultaneously grounded via through-holes (S1603*b*). In this way, by exciting the junction of slot elements 1103*a* and 1103*b* by means of microstrip line 1410*a*, the antenna apparatus can be fed.

Alternatively, if the output terminal of switch 1405*a* is connected to microstrip line 1406*b*, microstrip line 1410*b* is excited (S1604*a*). At this time, microstrip lines 1410*a*, 1410*c*, and 1415*a* through 1415*c* are simultaneously grounded via through-holes (S1604*b*). In this way, by exciting the junction of slot elements 1104*a* and 1104*b* by means of microstrip line 1410*b*, the antenna apparatus can be fed.

Alternatively, if the output terminal of switch 1405*a* is connected to microstrip line 1406*c*, microstrip line 1410*c* is excited (S1605*a*). At this time, simultaneously, microstrip lines 1410*a*, 1410*b*, and 1415*a* through 1415*c* are grounded via through-holes (S1605*b*). In this way, by exciting the junction of slot elements 1105*a* and 1105*b* by means of microstrip line 1410*c*, the antenna apparatus can be fed.

Next, the case where the output terminal of switch 1402 is connected to microstrip line 1404*b* will be considered. In S1606, the output destination of switch 1405*b* is determined. If the output terminal of switch 1405*b* is connected to microstrip line 1411*a*, microstrip line 1415*a* is excited (S1607*a*). At this time, simultaneously, microstrip lines 1410*a* through 1410*c*, 1415*b*, and 1415*c* are grounded via through-holes (S1607*b*). In this way, by exciting the junction of slot elements 1103*c* and 1103*d* by means of microstrip line 1415*a*, the antenna apparatus can be fed.

Alternatively, if the output terminal of switch 1405*b* is connected to microstrip line 1411*b*, microstrip line 1415*b* is excited (S1608*a*). At this time, simultaneously, microstrip lines 1410*a* through 1410*c*, 1415*a*, and 1415*c* are grounded via through-holes (S1608*b*). In this way, by exciting the junction of slot elements 1104*c* and 1104*d* by means of microstrip line 1415*b*, the antenna apparatus can be fed.

Alternatively, if the output terminal of switch 1405*b* is connected to microstrip line 1411*c*, microstrip line 1415*c* is excited (S1609*a*). At this time, simultaneously, microstrip lines 1410*a* through 1410*c*, 1415*a*, and 1415*b* are grounded via through-holes (S1609*b*). In this way, by exciting the junction of slot elements 1105*c* and 1105*d* by means of microstrip line 1415*c*, the antenna apparatus can be fed.

Thus, according to this embodiment, it is possible to switch the main beam direction in the vertical plane and conical plane with a feed switching configuration implemented by means of switching circuits and microstrip lines.

Embodiment 6

Figure 17:
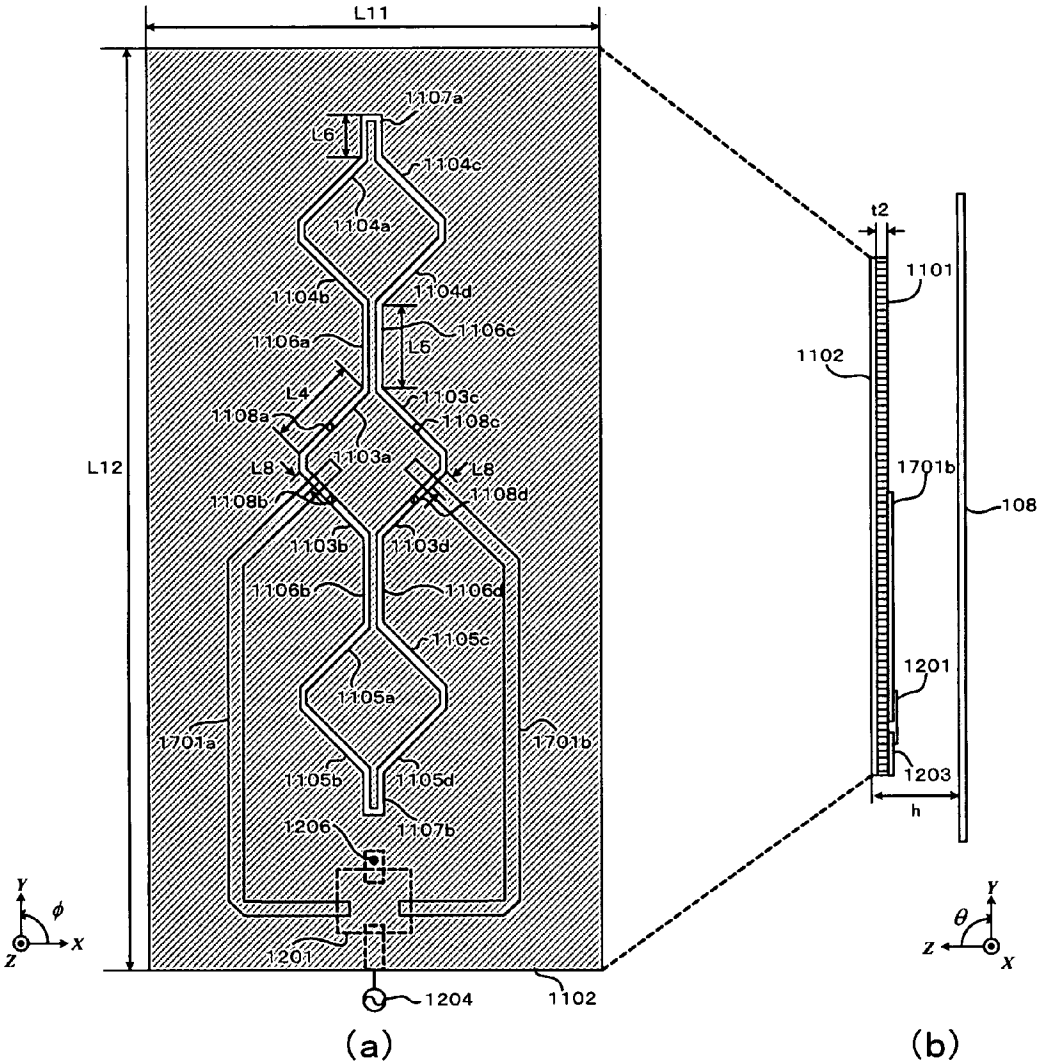
FIG. 17 is a configuration diagram of an antenna apparatus according to Embodiment 6 of the present invention.
Figure 18:
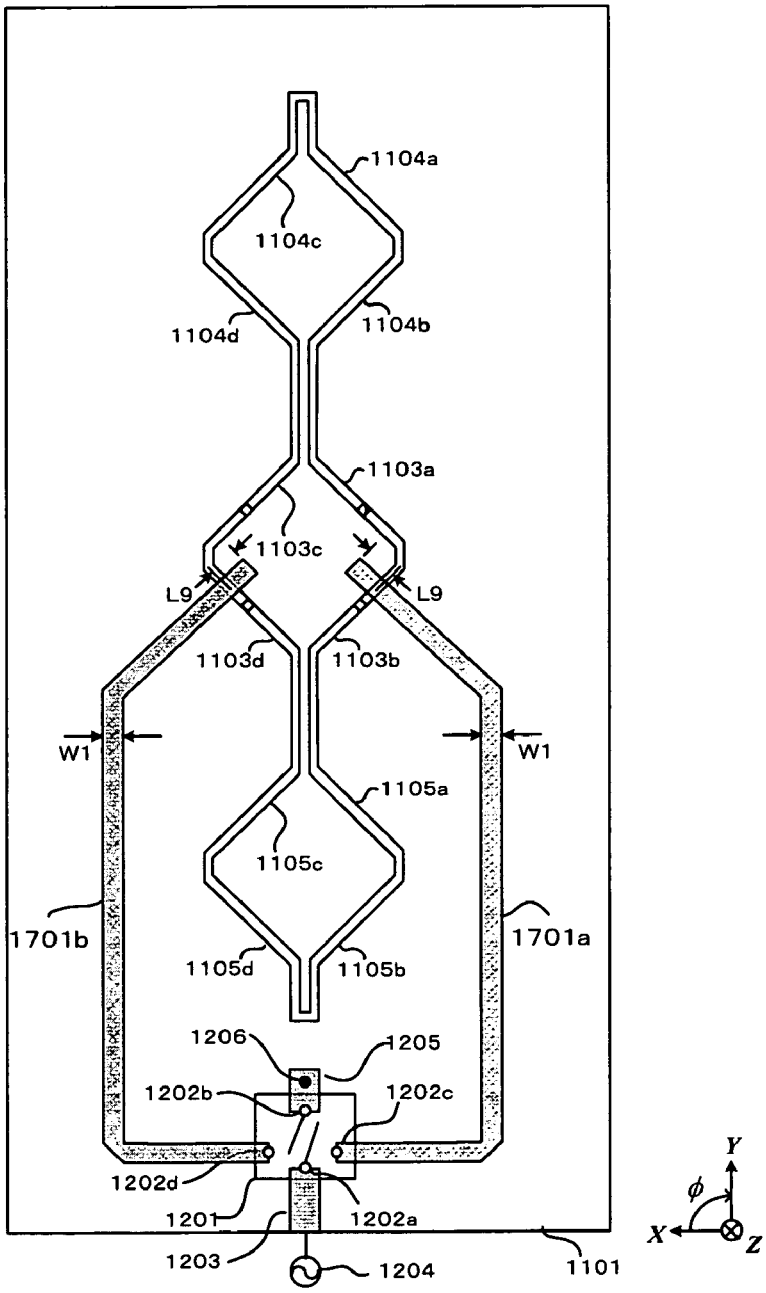
FIG. 18 is a planar view from the −Z side of an antenna apparatus according to Embodiment 6 of the present invention.

FIG. 17 and FIG. 18 are drawings showing the configuration of an antenna apparatus according to Embodiment 6 of the present invention. FIG. 17(*a*) is a planar view showing the antenna apparatus viewed from the +Z side, and FIG. 17(*b*) is an arrow view showing the antenna apparatus viewed from the +X side. FIG. 18 is a planar view of the antenna apparatus viewed from the −Z side, excluding plate reflector 108. In FIG. 17 and FIG. 18, parts common to FIG. 1, FIG. 11 and FIG. 12 are assigned the same reference numerals as in FIG. 1, FIG. 11 and FIG. 12 without further explanations. In the following description, the operating frequency is assumed to be 25 GHz. The coordinate axes shown in FIG. 17 and FIG. 18 are defined for convenience of explanation.

In this embodiment, a case is described in which the antenna apparatus excitation positions are shifted by L8 from the slot element junction in above described Embodiment 4. Here, one wavelength (one effective wavelength) is 7.2 mm, and L8 is approximately 0.18 wavelength.

Feed point 1204 is connected to input terminal 1202*a* via microstrip line 1203, and input terminal 1202*b* is connected to copper foil pattern 1205, and is grounded to copper foil layer 1102 which is a grounding conductor via through-hole 1206. Also, microstrip line 1701*a* is connected to output terminal 1202*c*, and a microstrip line 1701*b* is connected to output terminal 1202*d*. Above described microstrip line 1203 and copper foil pattern 1205 are copper foil patterns formed on the −Z side of dielectric substrate 1101.

Microstrip line 1701*a* is formed by means of a copper foil pattern on the −Z side of dielectric substrate 1101, with one end arranged so as to pass through slot element 1103*b*, and the other end connected to output terminal 1202*c* of switch 1201. Similarly, microstrip line 1701*b* is formed by means of a copper foil pattern on the −Z side of dielectric substrate 1101, with one end arranged so as to pass through slot element 1103*d*, and the other end connected to output terminal 1202*d* of switch 1201. Although not shown here, one end of microstrip line 1701*a* may be arranged so as to pass through slot element 1103*a*, and one end of microstrip line 1701*b* may be arranged so as to pass through slot element 1103*c*.

Width W1 of microstrip lines 1701*a* and 1701*b* is set to 0.6 mm so that the characteristic impedance is 50Ω. Distance L9 from the end of microstrip line 1701*a* to slot element 1103*b*, and distance L9 from the end of microstrip line 1701*b* to slot element 1103*d*, are set to 1.8 mm.

The operation in an antenna apparatus with the above described configuration when the antenna apparatus is excited from microstrip line 1701*a* will now be explained. A signal excited from feed point 1204 is inputted to input terminal 1202*a* of switch 1201. At this time, switch 1201 operates so that input terminal 1202*a* and output terminal 1202*c*, and input terminal 1202*b* and output terminal 1202*d*, are connected. Thus, the signal inputted to input terminal 1202*a* is inputted to microstrip line 1701*a* via output terminal 1202*c*.

On the other hand, microstrip line 1701*b* is grounded via input terminal 1202*b* and output terminal 1202*d*. Since the antenna elements are configured with slot elements, if magnetic fields are considered to be substituted for the electrical fields in the case of linear elements, it is necessary to create an open state at the junction of microstrip line 1701*b* and a slot element, that is, to ground the other end of microstrip line 1701*b*. Therefore, the length from the junction of microstrip line 1701*b* and a slot element to the grounding point—that is, the overall electrical length of microstrip line 1701*b*, copper foil pattern 1205, through-hole 1206, and switch 1201—must be set to an odd multiple of ¼ wavelength. By this means, it is possible to achieve high directional gain and a good F/B ratio.

Similarly, when the antenna apparatus is excited from microstrip line 1701*b*, switch 1201 operates so that input terminal 1202*a* and output terminal 1202*d*, and input terminal 1202*b* and output terminal 1202*c*, are connected. At this time, it is necessary to create an open state at the junction of microstrip line 1701*a* and a slot element, and therefore the length from the junction of microstrip line 1701*a* and the slot element to the grounding point must be set to an odd multiple of ¼ wavelength.

Figure 19:
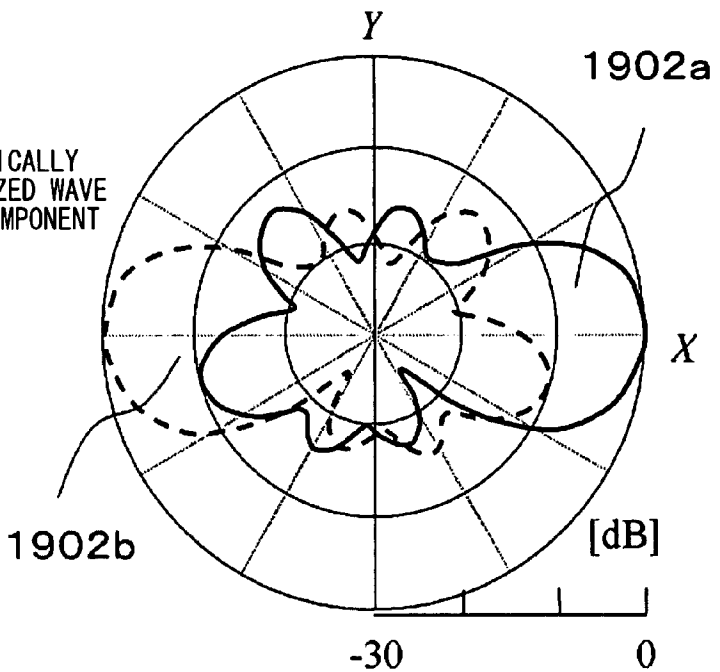
FIG. 19 is a drawing showing the directivity of an antenna apparatus according to Embodiment 6 of the present invention.
Figure 19:
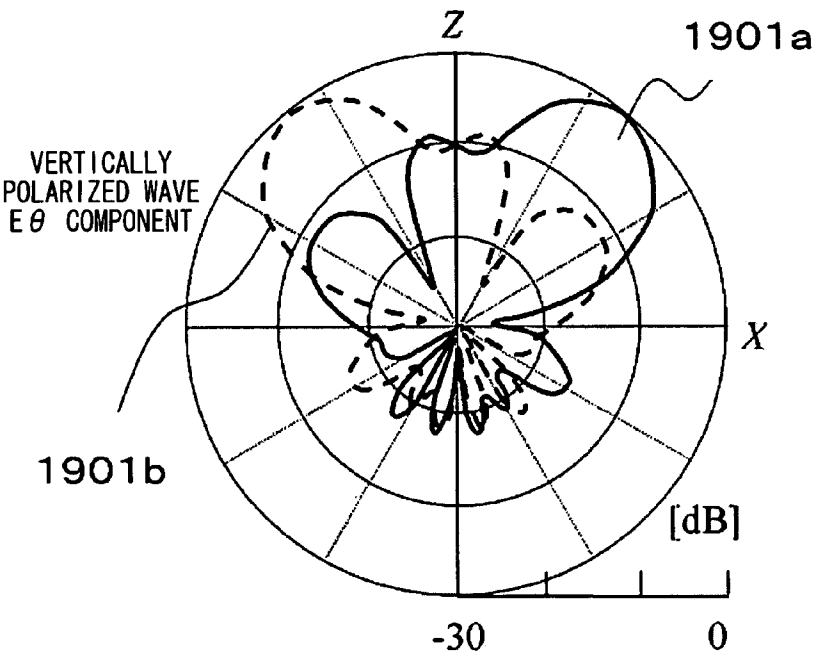
Figure 20:
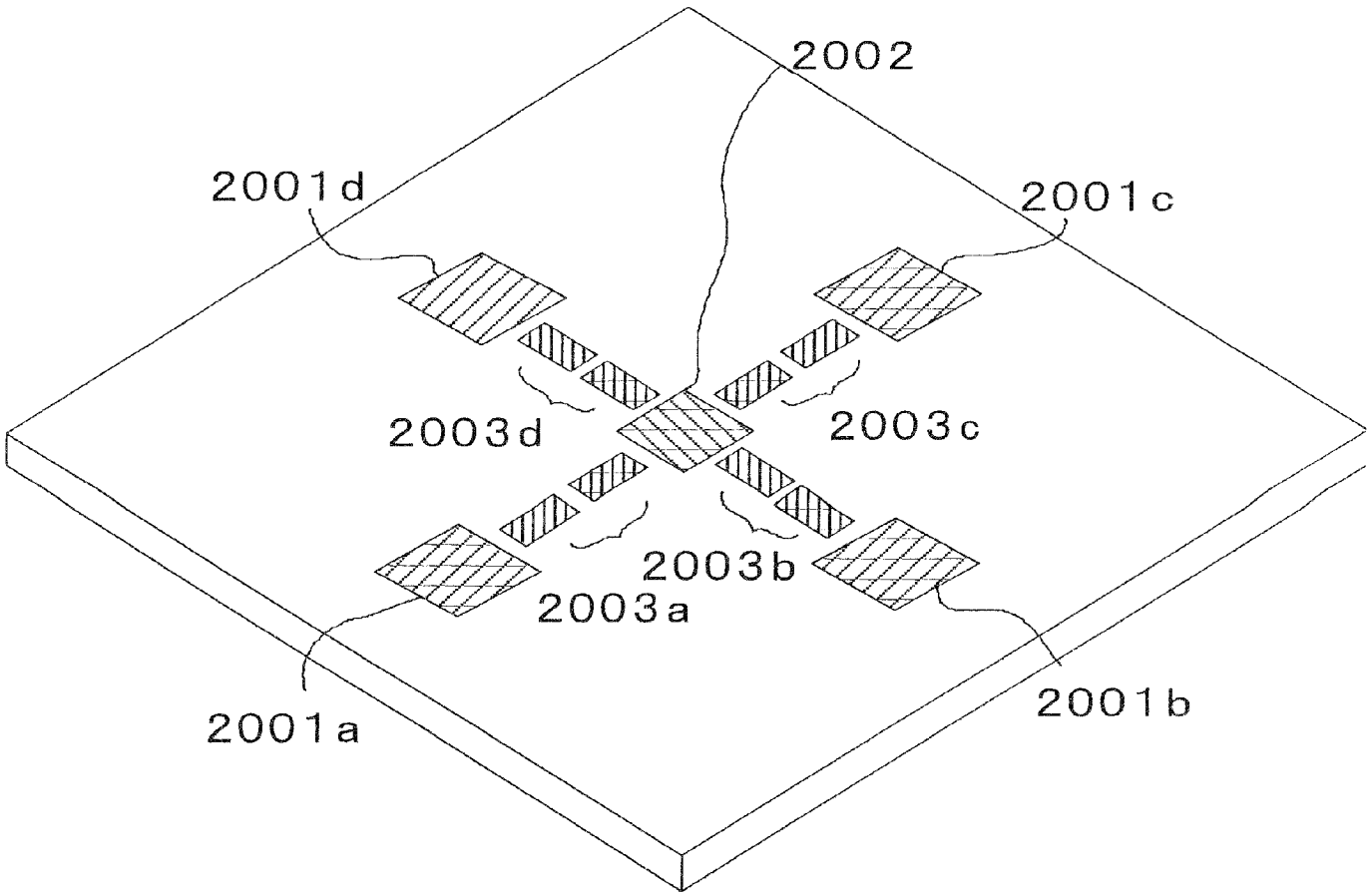
RELATED ART FIG.20
FIG. 20 is a configuration diagram of a patch Yagi-Uda array antenna shown in Patent Document 2.
Figure 21:
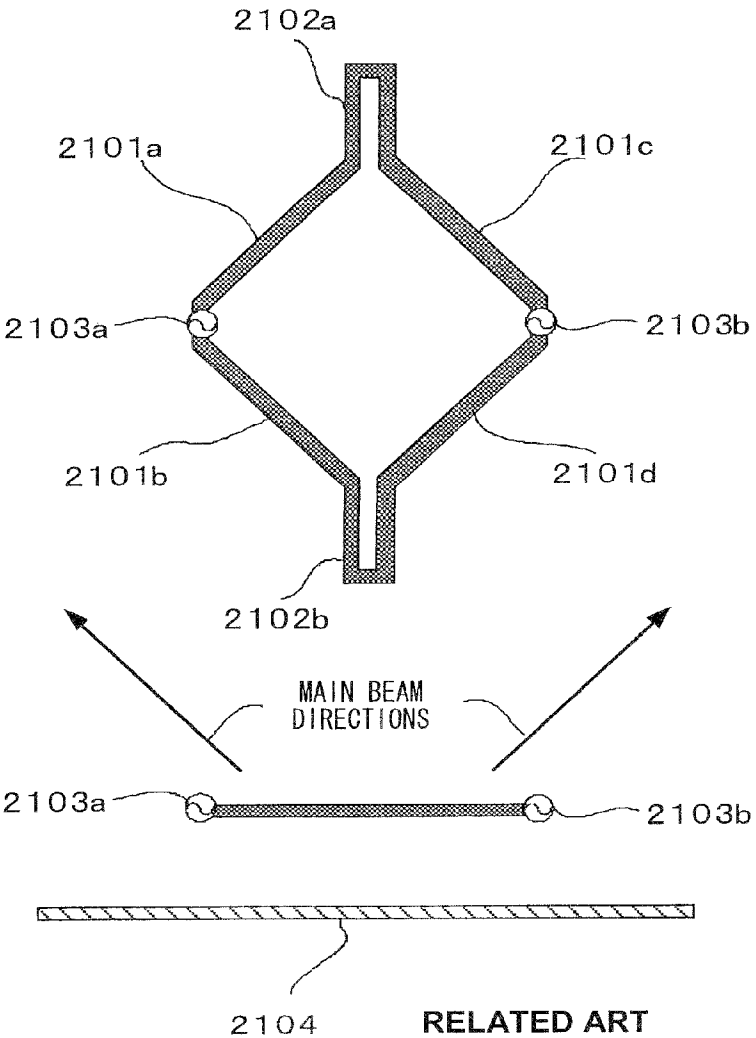
RELATED ART FIG.21
FIG. 21 is a configuration diagram of a detour element loaded loop antenna described in Non-Patent Document 1.

FIG. 19 is a drawing showing the directivity of an antenna apparatus according to Embodiment 6 of the present invention. FIG. 19(*a*) shows the directivity of the vertical (XZ) plane, and FIG. 19(*b*) shows the conical plane directivity with elevation angle θ of 40 degrees.

In FIG. 19(*a*), directivity 1901*a* indicated by a solid line shows the directivity of a vertically polarized wave (Eθ) component when the antenna apparatus is excited from microstrip line 1701*a*, and it can be confirmed that a main beam tilted in a direction in which elevation angle θ is 40 degrees is obtained. Directivity 1901*b* indicated by a dotted line shows the directivity of a vertically polarized wave (Eθ) component when the antenna apparatus is excited from microstrip line 1701*b*, and it can be confirmed that a main beam tilted in a direction in which elevation angle θ is 40 degrees is obtained.

In FIG. 19(*b*), directivity 1902*a* indicated by a solid line shows the directivity of a vertically polarized wave (Eθ) component when the antenna apparatus is excited from microstrip line 1701*a*, as in the case of directivity 1901*a* in FIG. 19(*a*), and it can be confirmed that the main beam is directed toward the +X direction. Directivity 902*b* indicated by a dotted line shows the directivity of a vertically polarized wave (Eθ) component when the antenna apparatus is excited from microstrip line 1701*b*, as in the case of directivity 1901*b* in FIG. 19(*a*), and it can be confirmed that the main beam is directed toward the −X direction. At this time, for both directivity 1902*a* and directivity 1902*b*, the main beam directional gain is 13.54 dBi, the conical plane half-power beam width is 30 degrees, and the F/B ratio is 13 dB.

Thus, according to this embodiment, it is possible to implement an antenna apparatus in which impedance matching and power feeding are simplified using microstrip lines, even with a configuration in which excitation is performed on slot elements between connecting conductors. Furthermore, it is possible to switch the main beam in two directions by switching power feeding to the microstrip lines using a switching circuit.

In this embodiment, slot elements are formed by means of copper foil patterns on a dielectric substrate, but a similar effect can also be obtained if slot elements are formed, for example, by providing voids in a conductive plate.

In this embodiment, connecting conductors have been described as being formed as copper foil patterns within slot elements, and connecting the inner copper foil layer and outer copper foil layer within slot elements so that the slot elements are divided approximately at their center, but a similar effect can also be obtained if connecting conductors are formed in the same plane as the microstrip lines, and connect the inner copper foil layer and outer copper foil layer via a through-hole.

In this embodiment, a configuration has been described in which connecting conductors are provided only in the center rhombic slot antenna section, but connecting conductors may also be provided in the rhombic slot antenna sections at both ends.

In this embodiment, a configuration has been described in which connecting conductors are provided only in the center rhombic slot antenna section, but connecting conductors may also be provided in a plurality of rhombic slot antenna sections.

In this embodiment, a case has been described in which a single DPDT switch is used as a switch, but a plurality of switches may also be used, as in a configuration, for example, using three SPDT (Single Pole Double Throw) switches.

In this embodiment, a case has been described in which one terminal of a switch is grounded, and the length from the junction of a microstrip line and slot element to the grounding point is made an odd multiple of ¼ wavelength, but high directional gain and a good F/B ratio can also be achieved with a configuration in which, for example, one terminal of the switch is left open, and the length from the junction of a microstrip line and slot element to the grounding point is made an integral multiple of ½ wavelength.

In this embodiment, a configuration has been described in which power is fed only to the center rhombic slot antenna section, but a configuration may also be used in which power is fed to the rhombic slot antenna sections at both ends.

In the above embodiments, cases have been described in which detour elements of a 3-element detour element loaded loop antenna are connected, but any number of elements may be used if within the scope of the above-described operating principles.

In the above embodiments, cases have been described in which rhombic antenna elements are connected, but "rhombic" here is used as a generic term for shapes including quadrilaterals, squares, parallelograms and trapezoids, and also including curved or round shapes. Therefore, a similar effect can also be obtained with, for example, circular antenna elements as one example of a round shape.

In the above embodiments, the length of linear elements and slot elements has been described as approximately ⅓ wavelength, but the directional gain and F/B ratio can be varied by varying the length of linear elements and slot elements. It is therefore preferable that the length of linear elements and slot elements is selected within a range of approximately ¼ wavelength to approximately ⅜ wavelength in order to achieve high directional gain and a good F/B ratio.

In the above embodiments, a case is assumed in which an antenna apparatus of the present invention is applied to an antenna for use in road-to-vehicle communication or vehicle-to-vehicle communication, but the present invention is not limited to such use.

An antenna apparatus of the present invention has the features described below. Firstly, an antenna apparatus adopts a configuration having a plurality of rhombic antenna sections in which four linear elements having lengths of approximately ¼ of the wavelength to approximately ⅜ of the wavelength of the used frequency are arranged in a rhombic shape in the same plane, and of the four linear elements, a first linear element and second linear element are connected and a third linear element and fourth linear element are connected, wherein the plurality of rhombic antenna sections are connected by a linear linking element having a predetermined length, a folded-back linear detour element having a predetermined full length is connected to each end of the linked plurality of rhombic antenna sections, a plate reflector is arranged at a predetermined distance from a plane in which the plurality of rhombic elements are arranged, and approximately parallel to that plane, the antenna apparatus having a first feed point that feeds power to the junction of the first linear element and second linear element out of one or another of the plurality of rhombic antenna sections, a second feed point that feeds power to a junction of the third linear element and fourth linear element, and a switching section that switches selectively between the first feed point and second feed point.

According to this configuration, it is possible to achieve high gain with a small, planar antenna apparatus. Also, by switching selectively between the first feed point and second feed point, it is possible to switch the main beam in two directions. Furthermore, it is possible to vary the angle of the main beam in the horizontal direction.

Secondly, the antenna apparatus adopts a configuration, further having a plurality of first feed points that feed power to the junction of a first linear element and second linear element of a plurality of rhombic antenna sections, a plurality of second feed points that feed power to a junction of a third linear element and fourth linear element, and a switching section that switches selectively between the plurality of first feed points and second feed points.

According to this configuration, it is possible to achieve high gain with a small, planar antenna apparatus. Also, by switching selectively between the plurality of first feed points and second feed points, it is possible to switch the main beam in two directions, and also to switch the angle of the main beam in the horizontal direction.

Thirdly, the antenna apparatus adopts a configuration further having a dielectric substrate that has a predetermined dielectric constant, and a conductive layer that is formed on a surface of the dielectric substrate, wherein, on the conductive layer, a plurality of rhombic slot antenna sections are provided in which four slot elements having lengths of approximately ¼ of the wavelength to approximately ⅜ of the wavelength of the used frequency are arranged in a rhombic shape, and out of the four slot elements, a first slot element and second slot element are connected and a third slot element and fourth slot element are connected, the plurality of rhombic slot antenna sections are connected by a slot linking element having a predetermined length, a folded-back slot detour element having a predetermined full length is connected to each end of the linked plurality of rhombic slot antenna sections, and a plate reflector is arranged at a predetermined distance from the surface of the dielectric substrate, and approximately parallel to the surface of the dielectric substrate, the antenna apparatus having a first feed point that feeds power to the junction of the first slot element and second slot element out of one or another of the plurality of rhombic slot antenna sections, a second feed point that feeds power to a junction of the third slot element and fourth slot element, and a switching section that switches selectively between the first feed point and second feed point.

According to this configuration, it is possible to achieve high gain with a small, planar antenna apparatus. Also, by switching selectively between the plurality of first feed points and second feed points, it is possible to switch the main beam in two directions.

Fourthly, the antenna apparatus adopts a configuration having a plurality of first feed points that feed power to the junction of a first slot element and second slot element of a plurality of rhombic slot antenna sections, a plurality of second feed points that feed power to a junction of a third slot element and fourth slot element, and a switching section that switches selectively between the plurality of first feed points and second feed points.

According to this configuration, by switching selectively between the plurality of first feed points and second feed points, it is possible to switch the main beam in two directions, and also to switch the angle of the main beam in the horizontal direction.

Fifthly, the antenna apparatus adopts a configuration, wherein a microstrip line provided on the rear surface of the surface on which the conductive layer of the dielectric substrate described in the third and fourth configurations is formed is used as a feed point.

According to this configuration, it is possible to achieve impedance matching by adjusting the length of the microstrip line, readily feed power to the antenna apparatus, and make the antenna apparatus smaller.

Sixthly, the antenna apparatus adopts a configuration, wherein a microstrip line has a switching section that switches between shorting and power feeding at a position of an odd multiple of approximately ¼ wavelength from a junction with a rhombic slot antenna section described in the third and fourth configurations.

According to this configuration, it is possible to implement an antenna apparatus with high directional gain and a good F/B ratio.

Seventhly, the antenna apparatus adopts a configuration, wherein the microstrip line has a switching section that switches between opening and power feeding at a position of an integral multiple of approximately ½ wavelength from a junction with a rhombic slot antenna section described in the third and fourth configurations.

According to this configuration, it is possible to implement an antenna apparatus with high directional gain and a good F/B ratio.

Eighthly, the antenna apparatus adopts a configuration, wherein, in at least one of a plurality of rhombic slot antenna sections, the inner conductive layer and outer conductive layer enclosed by the rhombic slot antenna sections are connected by means of a conductor formed as a copper foil pattern approximately in the center of the four slot elements.

According to this configuration, it is possible to implement an antenna apparatus in which impedance matching is easily achieved and F/B ratio is good.

Ninthly, the antenna apparatus adopts a configuration further having, in at least one of a plurality of rhombic slot antenna sections, a third feed point that feeds power on a slot element between conductors of a first slot element and second slot element to which a conductor is connected instead of a first feed point, a fourth feed point that feeds power on a slot element between conductors of a third slot element and fourth slot element to which a conductor is connected instead of a second feed point, and a switching section that switches selectively between the third feed point and fourth feed point.

According to this configuration, it is possible to implement an antenna apparatus in which impedance matching is easily achieved and that has a good F/B ratio.

As a more specific mode, an above described rhombic antenna section or above described rhombic slot antenna section is an antenna section or slot antenna section of rectangular shape including a quadrilateral, square, parallelogram and trapezoid, or of round shape including a curved and circular shape.

The present application is based on Japanese Patent Application No. 2004-345379 filed on Nov. 30, 2004, the entire content of which is expressly incorporated herein by reference.

INDUSTRIAL APPLICABILITY

An antenna apparatus according to the present invention can achieve high gain with a small, planar configuration, and is useful when applied as an antenna in a system in which beam switching is effective such as an antenna for a road-to-vehicle or vehicle-to-vehicle communication, for example.

The invention claimed is:

1. An antenna apparatus comprising a dielectric substrate that has a predetermined dielectric constant; and a conductive layer that is formed on a surface of said dielectric substrate, wherein:

on said conductive layer, a plurality of rhombic slot antenna sections are provided in which each rhombic slot antenna section comprises four slot elements having lengths of approximately ¼ of a wavelength to approximately ⅜ of a wavelength of a used frequency and arranged in a rhombic shape, and of the four slot elements, a first slot element and second slot element are connected, and a third slot element and fourth slot element are connected;

said plurality of rhombic slot antenna sections are connected by a slot linking element having a predetermined length and forming a linked plurality of rhombic slot antenna sections;

a folded-back slot detour element having a predetermined full length is connected to each end of the linked plurality of rhombic slot antenna sections; and a plate reflector is arranged at a predetermined distance from the surface of said dielectric substrate, and approximately parallel to the surface of said dielectric substrate, said antenna apparatus further comprising:

a first feed point that feeds power to a junction of said first slot element and said second slot element of one of said plurality of rhombic slot antenna sections;

a second feed point that feeds power to a junction of said third slot element and said fourth slot element; and a switching section that switches selectively between said first feed point and second feed point.

2. The antenna apparatus according to claim 1, further comprising:

a plurality of first feed points that feed power to a junction of said first slot element and said second slot element of said plurality of rhombic slot antenna sections;

a plurality of second feed points that feed power to a junction of said third slot element and said fourth slot element; and a switching section that switches selectively between said plurality of first feed points and second feed points.

3. The antenna apparatus according to claim 1, wherein a microstrip line provided on a rear surface of a surface on which said conductive layer of said dielectric substrate is formed is used as the feed point.

4. The antenna apparatus according to claim 1, wherein said microstrip line comprises a switching section that switches between shorting and power feeding at a position of an odd multiple of approximately ¼ wavelength from a junction with said rhombic slot antenna section.

5. The antenna apparatus according to claim 1, wherein said microstrip line comprises a switching section that switches between opening and power feeding at a position of an integral multiple of approximately ½ wavelength from a junction with said rhombic slot antenna section.

6. The antenna apparatus according to claim 1, wherein, in at least one of said plurality of rhombic slot antenna sections, an inner conductive layer and outer conductive layer enclosed by said rhombic slot antenna sections are connected by means of a conductor formed as a copper foil pattern approximately in a center of said four slot elements.

7. The antenna apparatus according to claim 1, in at least one of said plurality of rhombic slot antenna sections, further comprising:

a third feed point that feeds power on a slot element between conductors of said first slot element and said second slot element to which a conductor is connected instead of said first feed point;

a fourth feed point that feeds power on a slot element between conductors of said third slot element and said fourth slot element to which a conductor is connected instead of said second feed point; and a switching section that switches selectively between said third feed point and fourth feed point.

8. The antenna apparatus according to claim 1, wherein the rhombic slot antenna section is a square, quadrilateral, parallelogrammatic, trapezoidal, curved or circular slot antenna section.

* * * * *